US005521681A

United States Patent [19]

Nimura et al.

[11] Patent Number: 5,521,681

[45] Date of Patent: May 28, 1996

[54] IMAGE FORMING APPARATUS

[75] Inventors: Eiji Nimura; Shigeo Koyama; Wataru Yoshida; Kazuhisa Edahiro; Hidekazu Shouno, all of Osaka, Japan

[73] Assignee: Mita Industrial Co., Ltd., Osaka, Japan

[21] Appl. No.: 412,275

[22] Filed: Mar. 28, 1995

[30] Foreign Application Priority Data

| | | | |
|---|---|---|---|
| Apr. 15, 1994 | [JP] | Japan | 6-077655 |
| Apr. 15, 1994 | [JP] | Japan | 6-077656 |
| Apr. 15, 1994 | [JP] | Japan | 6-077661 |

[51] Int. Cl.[6] ..... G03G 21/00

[52] U.S. Cl. ..... 355/230; 355/75

[58] Field of Search ..... 355/230, 215, 355/67, 75, 228, 229

[56] References Cited

U.S. PATENT DOCUMENTS

| | | | |
|---|---|---|---|
| 3,695,760 | 10/1972 | Orr | 355/75 X |
| 3,807,856 | 4/1974 | Rodriguez | 355/67 |
| 4,090,788 | 5/1978 | Massengeil | 355/71 |
| 4,774,550 | 9/1988 | Igarashi | 355/67 |
| 4,954,862 | 9/1990 | Lee et al. | 355/67 X |
| 5,063,404 | 11/1991 | Milillo | 355/67 X |
| 5,136,328 | 8/1992 | Gooray et al. | 355/67 X |
| 5,179,413 | 1/1993 | Griffith | 355/229 |

*Primary Examiner*—Matthew S. Smith

*Attorney, Agent, or Firm*—Beveridge, DeGrandi, Weilacher & Young

[57] ABSTRACT

The present invention relates to an image forming apparatus such as a copying machine. In the image forming apparatus according to the present invention, a sealing member is interposed between a transparent platen on which an original is put and a frame member on which the transparent platen is mounted. Therefore, the sealing properties between the transparent platen and the frame member on which the transparent platen is mounted are improved, thereby to make it possible to prevent external air from entering the apparatus from a portion between the frame member and the transparent platen. As a result, it is possible to prevent image degradation and an increase in toner consumption.

16 Claims, 33 Drawing Sheets

(a)

IMAGE FORMING APPARATUS

BACKGROUND OF THE INVENTION

1. Field of the Invention

The present invention relates to an image forming apparatus such as a copying machine, a printer and a facsimile.

2. Description of the Prior Art

FIG. 40 illustrates a mounting structure of a transparent platen on a frame in a conventional copying machine. In the conventional copying machine, a plurality of rubber plates 701 are fixed on a frame 700, and a transparent platen 702 is mounted on the frame 700 in a state where the transparent platen 702 is disposed thereon.

In the above described copying machine, external air including dust enters the copying machine from a portion between the frame 700 and the transparent platen 702, whereby the inner surface of the transparent platen 702 and an optical system for exposure are liable to be dirty. Consequently, image degradation such as fogging occurs, and toner consumption becomes larger than necessary.

If the copying machine is installed in a so-called convenience store, dust-proof measures become significantly important. The reason for this is that the convenience store is located in the place where superior conditions of location for the traffic situation are satisfied, that is, faces on a street, and the copying machine is located in the vicinity of the entrance of the convenience store, whereby the copying machine is exposed to dust and solar light in many cases.

Dust-proof measures have been conventionally taken against the optical system for exposure in the copying machine. Specifically, in order to perform development using powder toner in the copying machine, the optical system for exposure must be protected from scattering of the toner. The optical system for exposure is generally protected from scattering of toner by separating a developing section and the optical system for exposure.

On the other hand, it is considered that the optical system for exposure is trapped in a sealed space so as to reduce the effect of the change in the external environment on the optical system for exposure as well as prevent dust and the like from entering the optical system for exposure from the exterior. As a light source for exposure in the copying machine, however, a halogen lamp generating a great amount of heat is generally used, whereby the optical system for exposure must be cooled. Therefore, it is difficult cause the optical system for exposure to have a sealed structure.

SUMMARY OF THE INVENTION

An object of the present invention is to provide an image forming apparatus capable of preventing external air from entering the apparatus from a portion between a frame member and a transparent platen and capable of preventing image degradation and an increase in toner consumption.

Another object of the present invention is to provide an image forming apparatus capable of trapping an optical system for exposure in a sealed space, capable of reducing the effect of the change in the external environment on the optical system for exposure and capable of preventing dust and the like from entering the optical system for exposure from the exterior.

A first image forming apparatus according to the present invention is characterized in that a sealing member is interposed between a transparent platen on which an original is put and a frame member on which the transparent platen is mounted.

A second image forming apparatus according to the present invention is characterized in that a plurality of height positioning sections in an upward projected shape are formed on the upper surface of a frame member, a sealing member is disposed on the upper surface of the frame member in such a manner as to pass outside or inside the height positioning sections, and a transparent platen is mounted on the frame member in a state where it is pressed against the sealing member and is received by the height positioning sections. As the sealing member, an endless-shaped sealing member, for example, is used.

A third image forming apparatus according to the present invention is characterized in that a plurality of height positioning sections in an upward projected shape are formed on the upper surface of a frame member, notches in which the height positioning sections are fitted are respectively formed in positions corresponding to the height positioning sections in a sealing member, the sealing member is disposed on the upper surface of the frame member in such a manner that the height positioning sections are respectively fitted in the notches in the sealing member, and a transparent platen is mounted on the frame member in a state where it is pressed against the sealing member. As the sealing member, an endless-shaped sealing member, for example, is used.

A fourth image forming apparatus according to the present invention is characterized in that a plurality of height positioning sections in an upward projected shape are formed on the upper surface of a frame member, a sealing member is constituted by a plurality of sealing member parts respectively corresponding to portions between the adjacent height positioning sections on the upper surface of the frame member, the sealing member parts are respectively fitted in the corresponding portions out of the portions between the adjacent height positioning sections on the upper surface of the frame member, and a transparent platen is mounted on the frame member in a state where it is pressed against the sealing member and is received by the height positioning sections.

In the first, second, third or fourth image forming apparatus according to the present invention, the sealing properties between the transparent platen and the frame member on which the transparent platen is mounted are improved, thereby to make it possible to prevent external air from entering the apparatus from the portion between the frame member and the transparent platen. Therefore, it is possible to prevent image degradation and an increase in toner consumption.

A fifth image forming apparatus according to the present invention is an image forming apparatus in which an original image is exposed by moving an exposure lamp, which is characterized in that a fluorescent lamp is used as the exposure lamp, and an optical system for exposure including the exposure lamp is disposed in a sealed casing.

A sixth image forming apparatus according to the present invention is an image forming apparatus in which an original image is exposed by moving an exposure lamp, which is characterized in that a fluorescent lamp is used as the exposure lamp, an optical system for exposure including the exposure lamp is disposed in a sealed casing, the sealed casing is constituted by a case having a window for exposure and a transparent platen mounted on the case in such a manner as to close the window for exposure, and a sealing member is interposed between a portion around the window for exposure in the case and the transparent platen.

A seventh image forming apparatus according to the present invention is an image forming apparatus in which an original image is exposed by moving an exposure lamp, which is characterized in that a fluorescent lamp is used as the exposure lamp, an optical system for exposure including the exposure lamp is disposed in a sealed casing, the sealed casing is constituted by a case having a window for exposure and a transparent platen mounted on the case in such a manner as to close the window for exposure, the case is constituted by a case body opening upward and a cover fixed to the case body and having the window for exposure, and a sealing member is interposed between a portion around the window for exposure in the cover and the transparent platen.

An eighth image forming apparatus according to the present invention is an image forming apparatus in which an original image is exposed by moving an exposure lamp, which is characterized in that a fluorescent lamp is used as the exposure lamp, an optical system for exposure including the exposure lamp is disposed in a sealed casing, the sealed casing is constituted by a case having a window for exposure and a transparent platen mounted on the case in such a manner as to close the window for exposure, the case is constituted by a case body having the window for exposure on its upper surface and opening downward and a bottom fixed to the case body, and a sealing member is interposed between a portion around the window for exposure in the case body and the transparent platen.

In the sixth, seventh and eighth image forming apparatuses, a mounting structure of the transparent platen on the case may be the following structures (1) to (3), for example.

(1) A plurality of height positioning sections in an upward projected shape are formed in the portion around the window for exposure in the case, the sealing member is disposed in such a manner as to pass outside or inside the height positioning sections in the portion around the window for exposure in the case, and the transparent platen is mounted on the case in a state where it is pressed against the sealing member and is received by the height positioning sections.

(2) A plurality of height positioning sections in an upward projected shape are formed in the portion around the window for exposure in the case, notches in which the height positioning sections are fitted are respectively formed in positions corresponding to the height positioning sections in the sealing member, the sealing member is disposed in the portion around the window for exposure in the case in such a manner that the height positioning sections are respectively fitted in the notches in the sealing member, and the transparent platen is mounted on the case in a state where it is pressed against the sealing member.

(3) A plurality of height positioning sections in an upward projected shape are formed in the portion around the window for exposure in the case, the sealing member is constituted by a plurality of sealing member parts respectively corresponding to portions between the adjacent height positioning sections in the portion around the window for exposure in the case, the sealing member parts are respectively fitted in the corresponding portions out of the portions between the adjacent height positioning sections in the portion around the window for exposure in the case, and the transparent platen is mounted on the case in a state where it is pressed against the sealing member and is received by the height positioning sections.

In the fifth, sixth, seventh or eighth image forming apparatus according to the present invention, the optical system for exposure including the exposure lamp is disposed in the sealed casing, whereby the optical system for exposure is not easily affected by the external temperature and humidity and dust from the exterior.

In the sixth, seventh or eighth image forming apparatus according to the present invention, the sealing properties between the case and the transparent platen are enhanced, thereby to make it possible to reliably prevent dust from entering the apparatus from a portion between the case and the transparent platen as well as enhance the sealing properties of the case.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
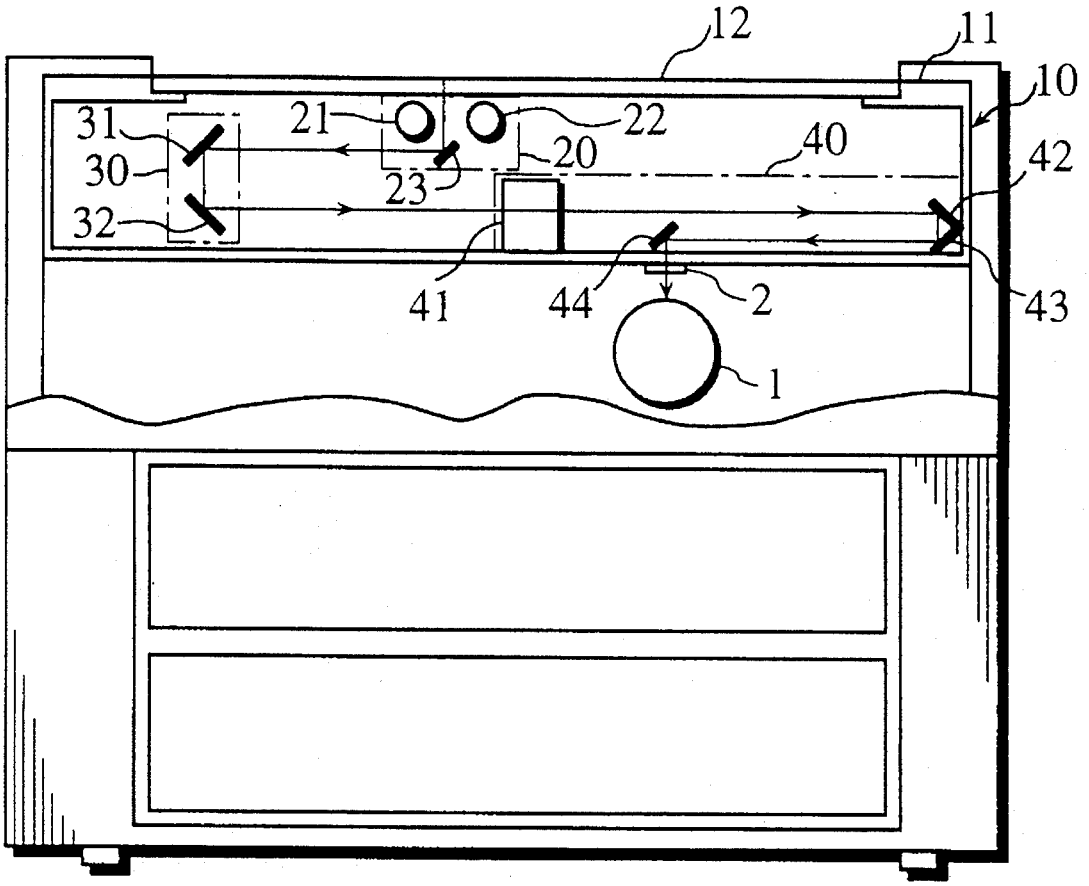
FIG. 1 is a schematic view showing the entire construction of an electrophotographic copying machine.

Referring now to the drawings, embodiments of the present invention will be described.

FIG. 1 illustrates the entire construction of an electrophotographic copying machine.

A copying machine is constituted by a main body, an optical system for exposure which is provided in the upper part of the main body, and a developing section and a paper conveying mechanism which are provided below the optical system for exposure in the main body.

The developing section comprises a photosensitive drum 1. A charger for charging a photosensitive layer on the surface of the photosensitive drum 1, a developing device for developing an electrostatic latent image formed on the photosensitive layer into a toner image, a transferring corona discharger for transferring the toner image formed on the photosensitive layer on paper, a separating corona discharger for separating the paper from the photosensitive drum 1, a cleaning device for removing toner remaining on the surface of the photosensitive drum 1 after the transfer, and the like, which are not illustrated, are arranged around the photosensitive drum 1.

The optical system for exposure is contained in a sealed casing 10. The sealed casing 10 comprises a case 11 having a window for exposure on its upper surface, and a transparent platen 12 mounted on the case 11 in such a manner as to seal the window for exposure.

The optical system for exposure is constituted by a first optical system traveling body 20, a second optical system traveling body 30, and a lens unit 40.

The first optical system traveling body 20 comprises a pair of exposure lamps 21 and 22 for exposing and scanning an image of an original put on the transparent platen 12 and a first mirror 23 for reflecting light reflected from the original.

The second optical system traveling body 30 comprises second and third mirrors 31 and 32 for introducing light reflected by the first mirror 23 in the first optical system traveling body 20 into the lens unit 40.

The lens unit 40 comprises a lens 41 on which light reflected by the third mirror 32 in the second optical system traveling body 30 is incident, and fourth, fifth and sixth mirrors 42, 43 and 44 for introducing light emitted from the lens 41 into the surface of the photosensitive drum 1. The photosensitive drum 1 is irradiated by light emitted from the lens unit 40, whereby an electrostatic latent image is formed on the photosensitive layer on the surface of the photosensitive drum 1.

The first optical system traveling body 20 and the second optical system traveling body 30 are reciprocated rightward and leftward by a scan motor (not shown). The second optical system traveling body 30 is moved over a distance which is one-half the moving distance of the first optical system traveling body 20 at a speed which is one-half the speed of the first optical system traveling body 20. The description of the paper conveying mechanism will be omitted.

Figure 2:
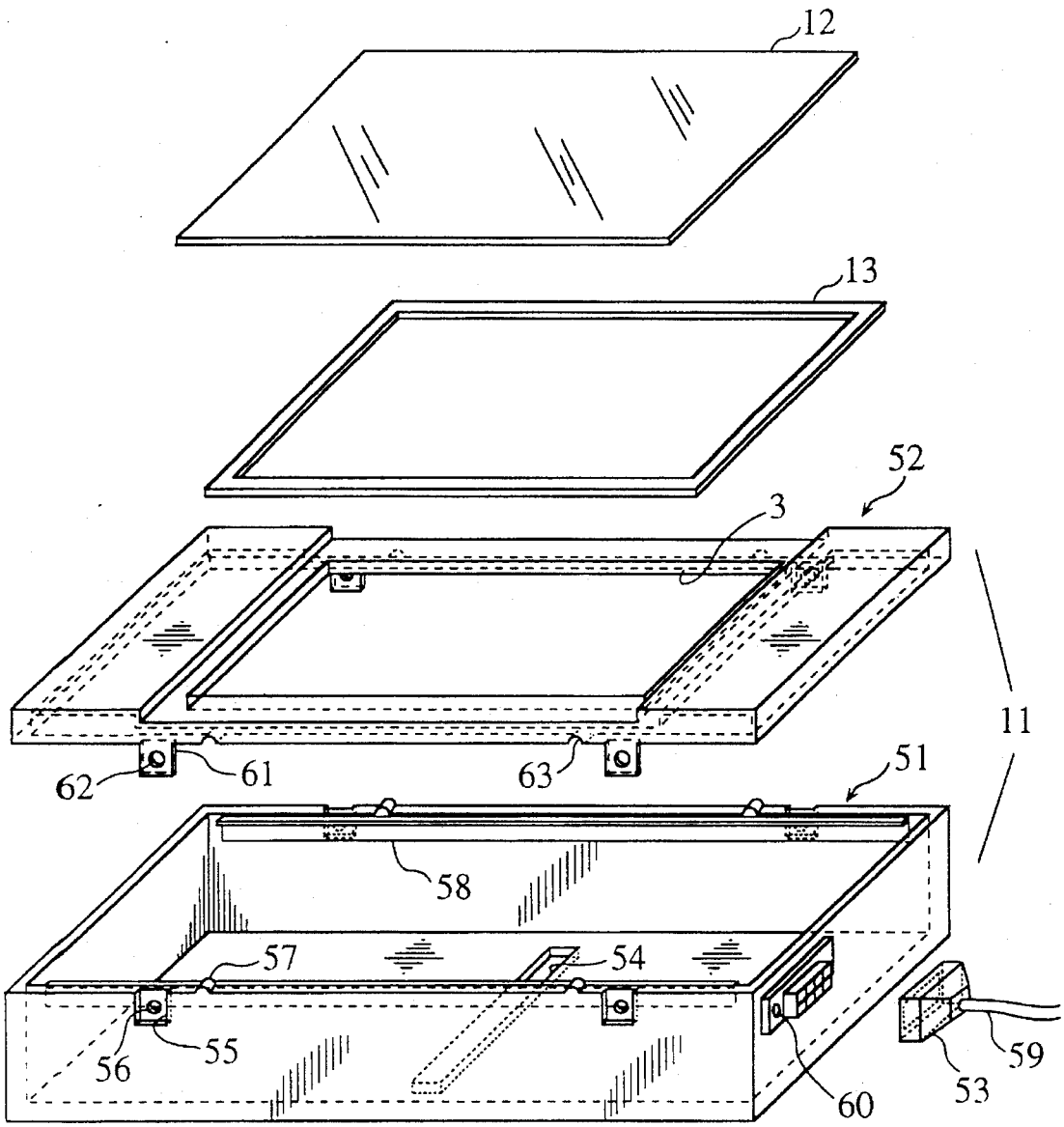
FIG. 2 is an exploded perspective view showing a sealed casing containing an optical system for exposure.

FIG. 2 illustrates the sealed casing 10 containing the optical system for exposure.

The sealed casing 10 comprises a case 11 having a window for exposure 3 on its upper surface, a transparent platen 12 mounted on the case 11 in such a manner as to close the window for exposure 3, and a sealing member 13 in a rectangular frame shape which is interposed between the case 11 and a peripheral edge on the lower surface of the transparent platen 12.

The case 11 comprises a case body 51 in a rectangular parallelopiped shape opening upward and a cover 52 having the window for exposure 3. A slit 54 for introducing light from the lens unit 40 into the photosensitive drum 1 is formed on the bottom surface of the case body 51. The slit 54 is sealed by a glass plate 2 (see FIG. 1). Two notches 55 are formed in an upper end of each of the outer surfaces of both front and rear sidewalls of the case body 51. Screw holes 56 are respectively formed in portions where the notches 55 of both the front and rear sidewalls of the case body 51 are formed.

Furthermore, two positioning projections 57 are formed in an upper end surface of each of both the front and rear sidewalls of the case body 51. In this example, guide rails 58 in an L shape in cross section longitudinally extending so as to guide the first and second optical system traveling bodies 20 and 30 are respectively mounted on the inner surfaces of both the front and rear sidewalls of the case body 51. The guide rail 58 also functions as a reinforcing member of the case body 51. A connector 60 for connecting an electrical code extending from an equipment inside the optical system for exposure to an electrical code 59 outside the case body 51 is mounted on the right sidewall of the case body 51. A connector 53 mounted on the electrical code 59 outside the case body 51 is subjected to a sealing mechanism for preventing the sealing properties of the case body 51 from being degraded by the connector 60.

A portion around the window for exposure 3 of the cover 52 is so formed that the height of the upper surface thereof is smaller than that of portions in both right and left ends of the cover 52. The low portion around the window for exposure 3 of the cover 52 is referred to as a rectangular frame-shaped portion. Downward projections 61 to be fitted in the notches 55 of the case body 51 are respectively formed in positions corresponding to the notches 55 in front and rear edges on the lower surface of the cover 52. Each of the downward projections 61 is provided with a screw insertion hole 62. In addition, groove-shaped notches 63 in which the projections 57 of the case body 51 are to be fitted are respectively formed in positions corresponding to the projections 57 in the front and rear edges on the lower surface of the cover 52.

The sealing member 13 in a rectangular frame shape is disposed on the upper surface of the rectangular frame-shaped portion around the window for exposure 3 of the cover 52. In addition, the transparent platen 12 is disposed on the sealing member 13. The transparent platen 12 is mounted on the cover 52 by a fixture (not shown) in a state where the sealing member 13 is pressed by the transparent platen 12.

The cover 52 is disposed on the case body 51 in such a manner that the projections 61 are fitted in the notches 55 of the case body 51 and the notches 63 are fitted in the projections 57 of the case body 51, and then is fixed to the case body 51 by respectively getting screws (not shown) into the screw holes 56 of the case body 51 from the screw insertion holes 62 of the projections 61 to tighten the screws.

The case body 51 and the cover 52 are produced by integrally forming synthetic resin, for example. The case body 51 and the cover 52 may be produced by processing a sheet metal.

Figure 3:
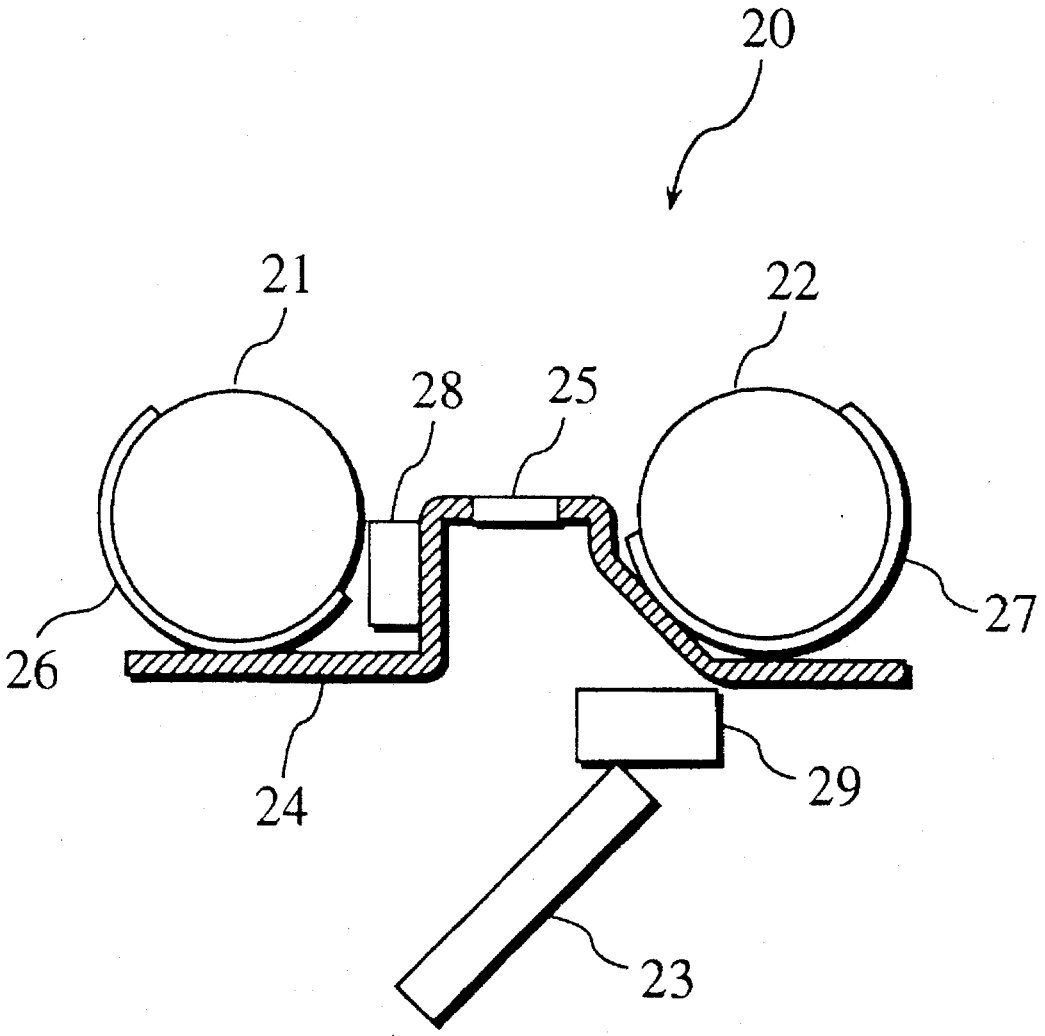
FIG. 3 is a transverse sectional view showing the construction of a first optical system traveling body.

FIG. 3 illustrates the detailed construction of the first optical system traveling body 20.

The first optical system traveling body 20 comprises a slit plate 24 having a slit 25 extending backward and forward, a pair of exposure lamps 21 and 22 extending backward and forward, and a first mirror 23. As the exposure lamps 21 and 22, a fluorescent lamp of a hot cathode type is used. A fluorescent lamp of the other type such as a cold cathode type may be used as the exposure lamps 21 and 22.

Surface-shaped heating elements 26 and 27 longitudinally extending are respectively affixed to portions around the fluorescent lamps 21 and 22. In addition, the first optical system traveling body 20 is provided with a temperature sensor 28 for sensing the peripheral temperatures of the fluorescent lamps 21 and 22. Further, the first optical system traveling body 20 is provided with a light quantity sensor 29 for sensing the quantity of light reflected from the original.

Light emitted from each of the fluorescent lamps 21 and 22 is reflected by the original on the transparent platen 12. The reflected light is incident on the first mirror 23 through the slit 25. The light incident on the first mirror 23 is reflected by the first mirror 23 to the second optical system traveling body 30.

Figure 5:
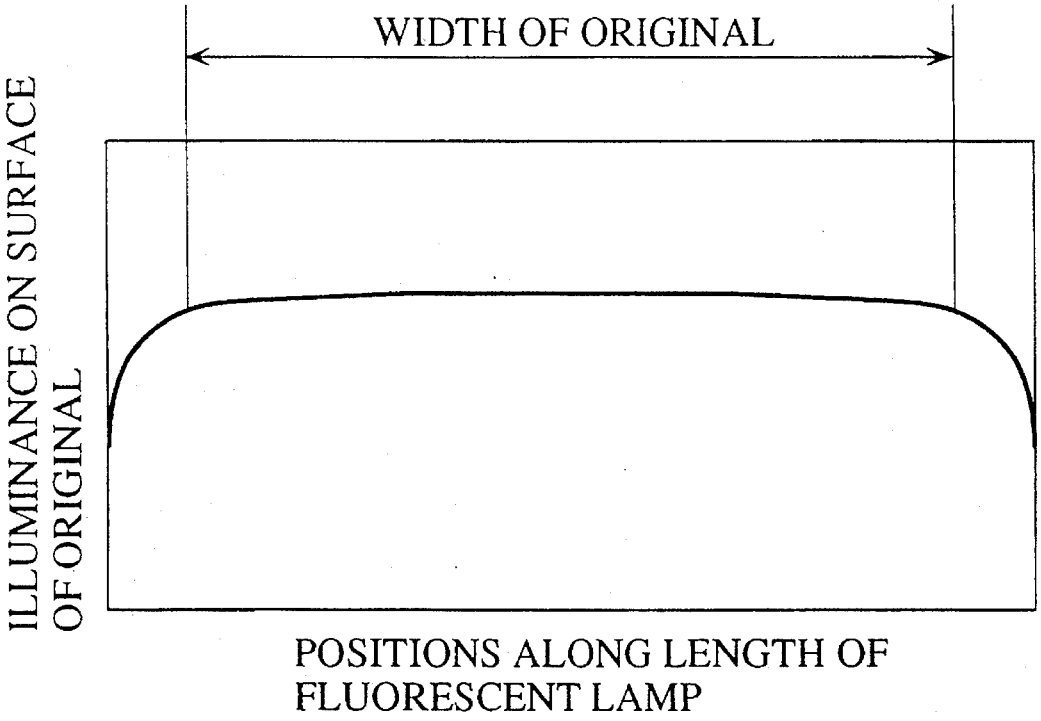
FIG. 5 is a graph of illuminance characteristics on the surface of an original against positions along the length of a fluorescent lamp.
Figure 6:
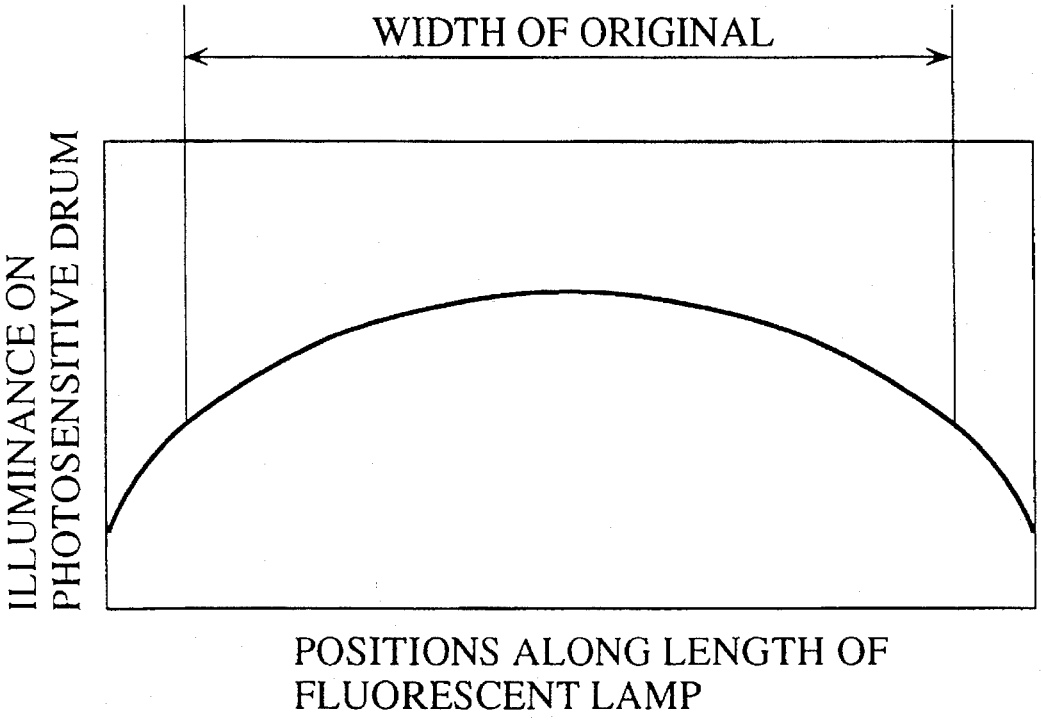
FIG. 6 is a graph of illuminance characteristics on the surface of a photosensitive drum against positions along the length of a fluorescent lamp in a case where a slit plate having a slit uniform in width along its length is used.

FIG. 5 is a graph of illuminance characteristics on the surface of an original against positions along the length of each of the fluorescent lamps 21 and 22. In addition, FIG. 6 is a graph of illuminance characteristics on the surface of the photosensitive drum 1 against positions along the length of each of the fluorescent lamps 21 and 22 in a case where the slit plate having a slit uniform in width along its length is used. The illuminance on the surface of the original against the positions along the length of each of the fluorescent lamps 21 and 22 is approximately constant except for the illuminance in both ends as shown in FIG. 5. However, illuminance obtained on the surface of the photosensitive drum 1 after light passes through the lens 41 is decreased toward both ends along the length of each of the fluorescent lamps 21 and 22, as shown in FIG. 6, by the characteristics of the lens 41.

Figure 4:
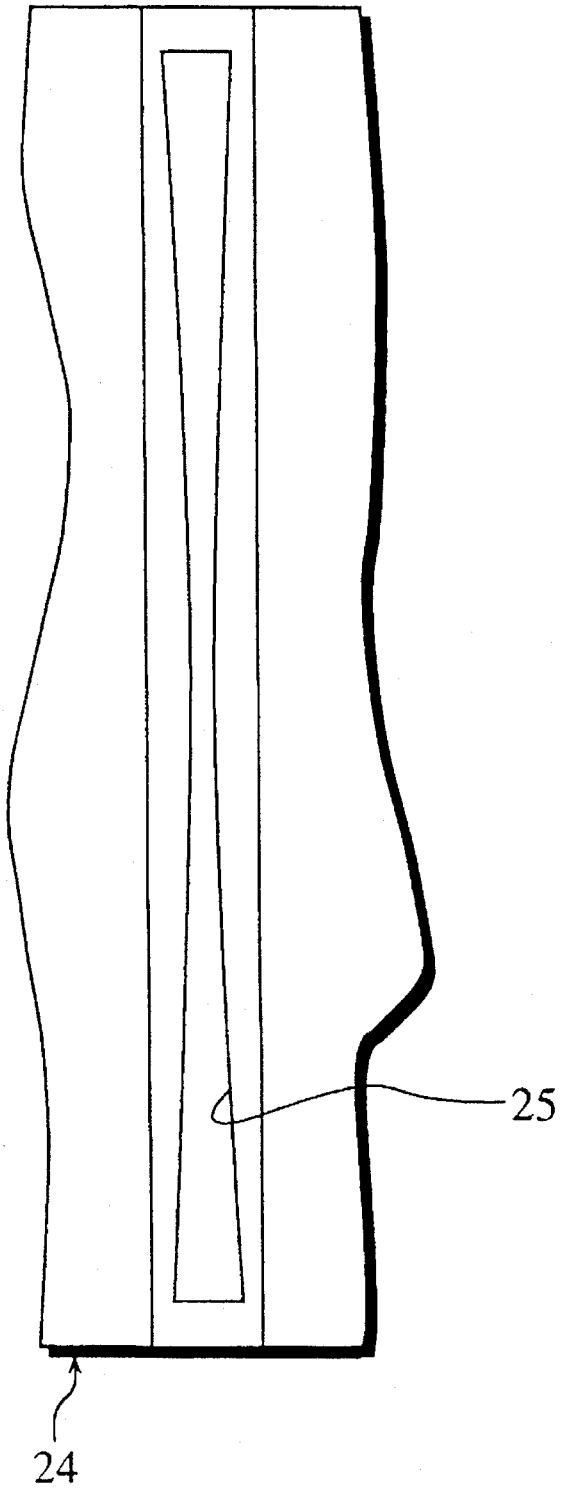
FIG. 4 is a plan view showing a slit plate.
Figure 7:
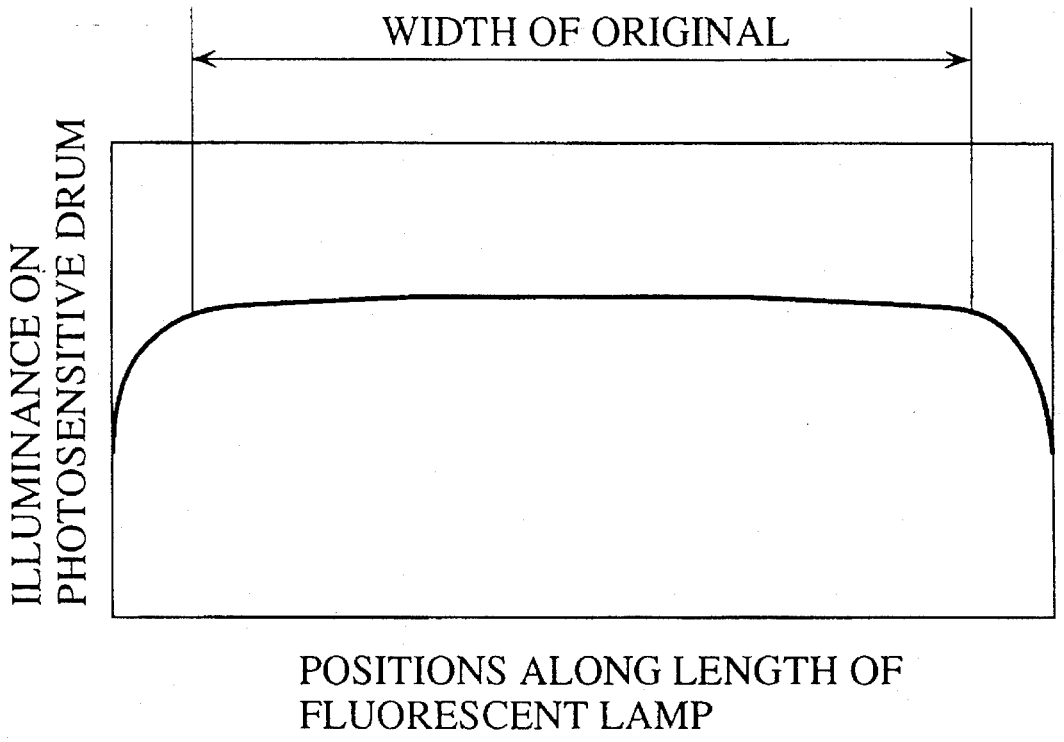
FIG. 7 is a graph of illuminance characteristics on the surface of a photosensitive drum against positions along the length of a fluorescent lamp in a case where the slit plate shown in FIG. 4 is used.

In order to make the illuminance obtained on the surface of the photosensitive drum 1 after light passes through the lens 41 constant along the length of each of the fluorescent lamps 21 and 22, therefore, the width in the center along the length of the slit 25 of the slit plate 24 is the smallest, and the width thereof is increased toward both ends of the slit 25, as shown in FIG. 4. FIG. 7 is a graph of illuminance characteristics on the surface of the photosensitive drum 1 against positions along the length of each of the fluorescent lamps 21 and 22 after correcting the illuminance by the slit 25 as shown in FIG. 4.

Figure 8:
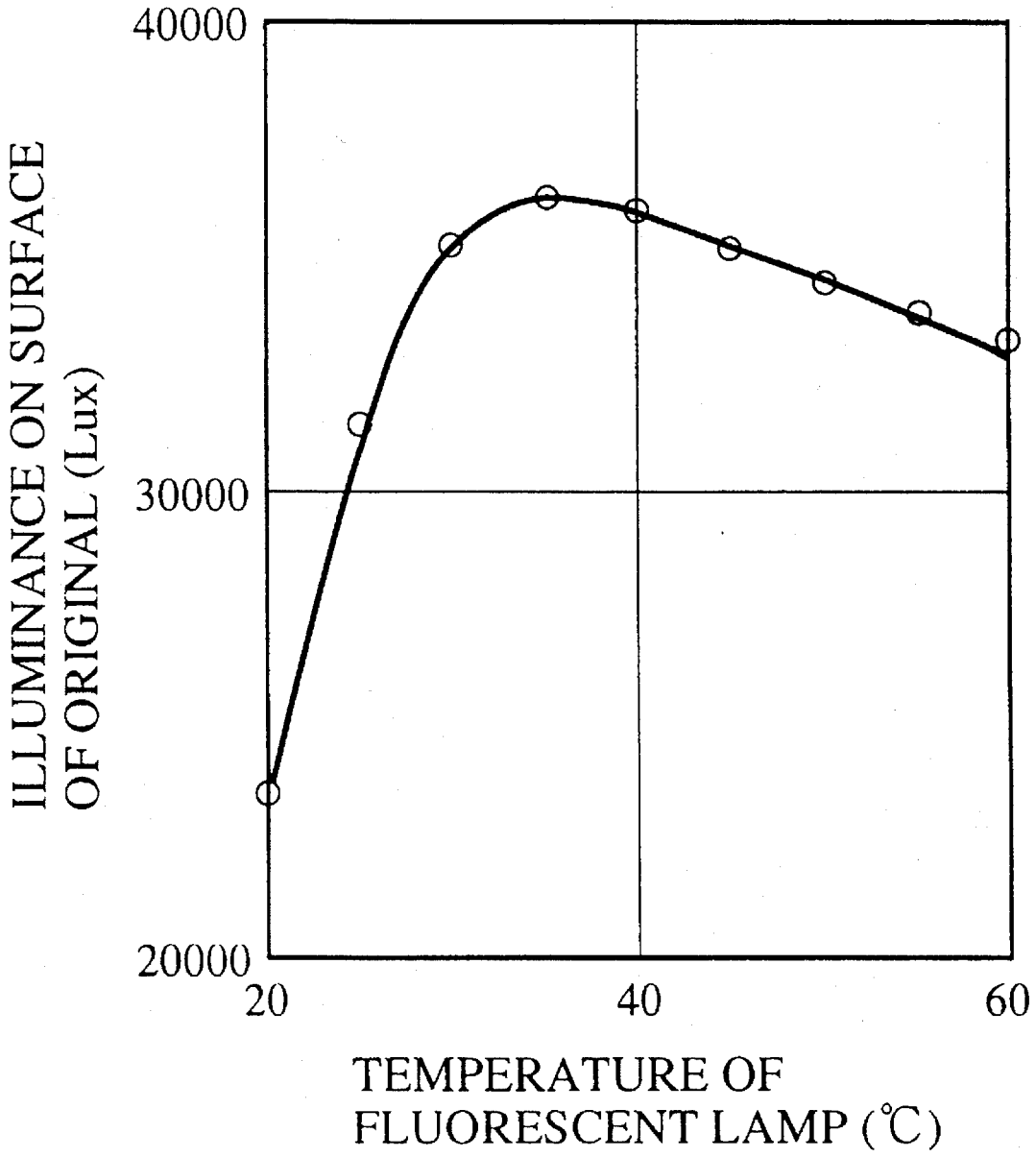
FIG. 8 is a graph of illuminance characteristics on the surface of an original against the temperature of a fluorescent lamp.
Figure 9:
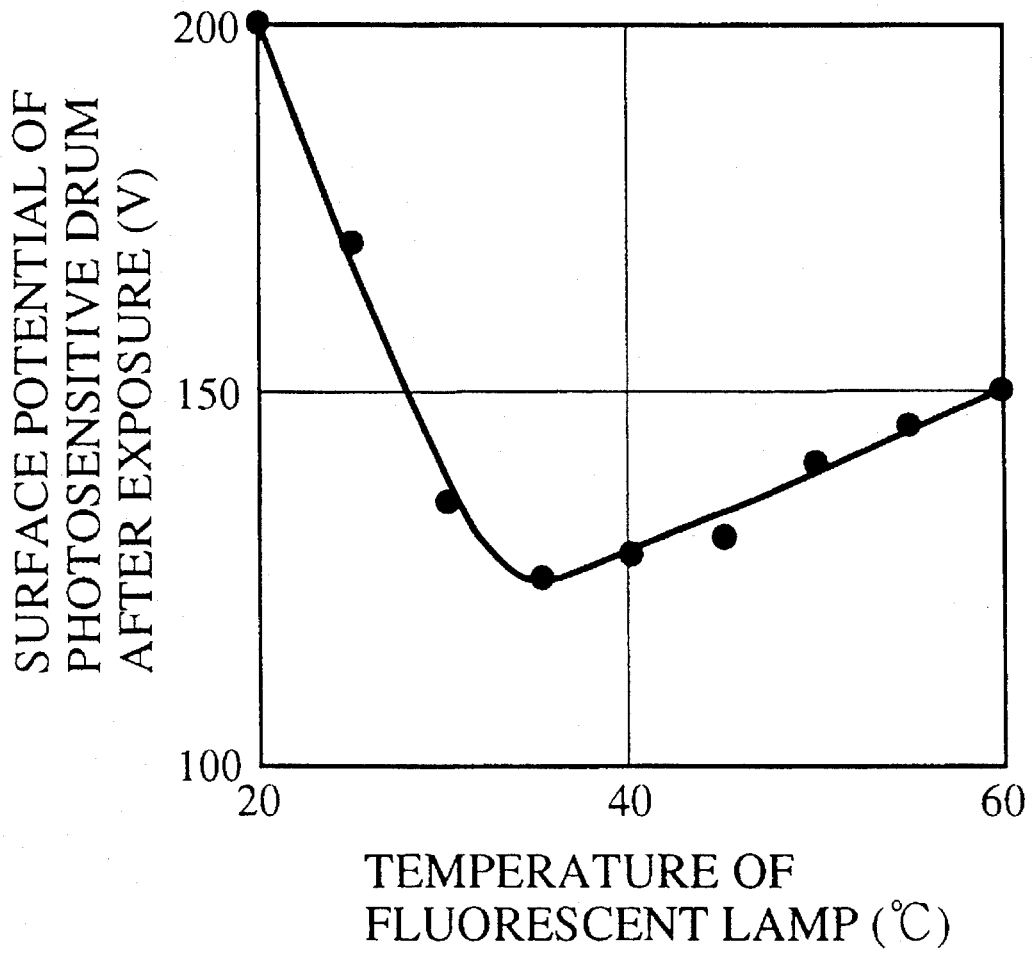
FIG. 9 is a graph of the surface potential characteristics of a photosensitive drum against the temperature of a fluorescent lamp in a case where a white original is exposed.
Figure 10:
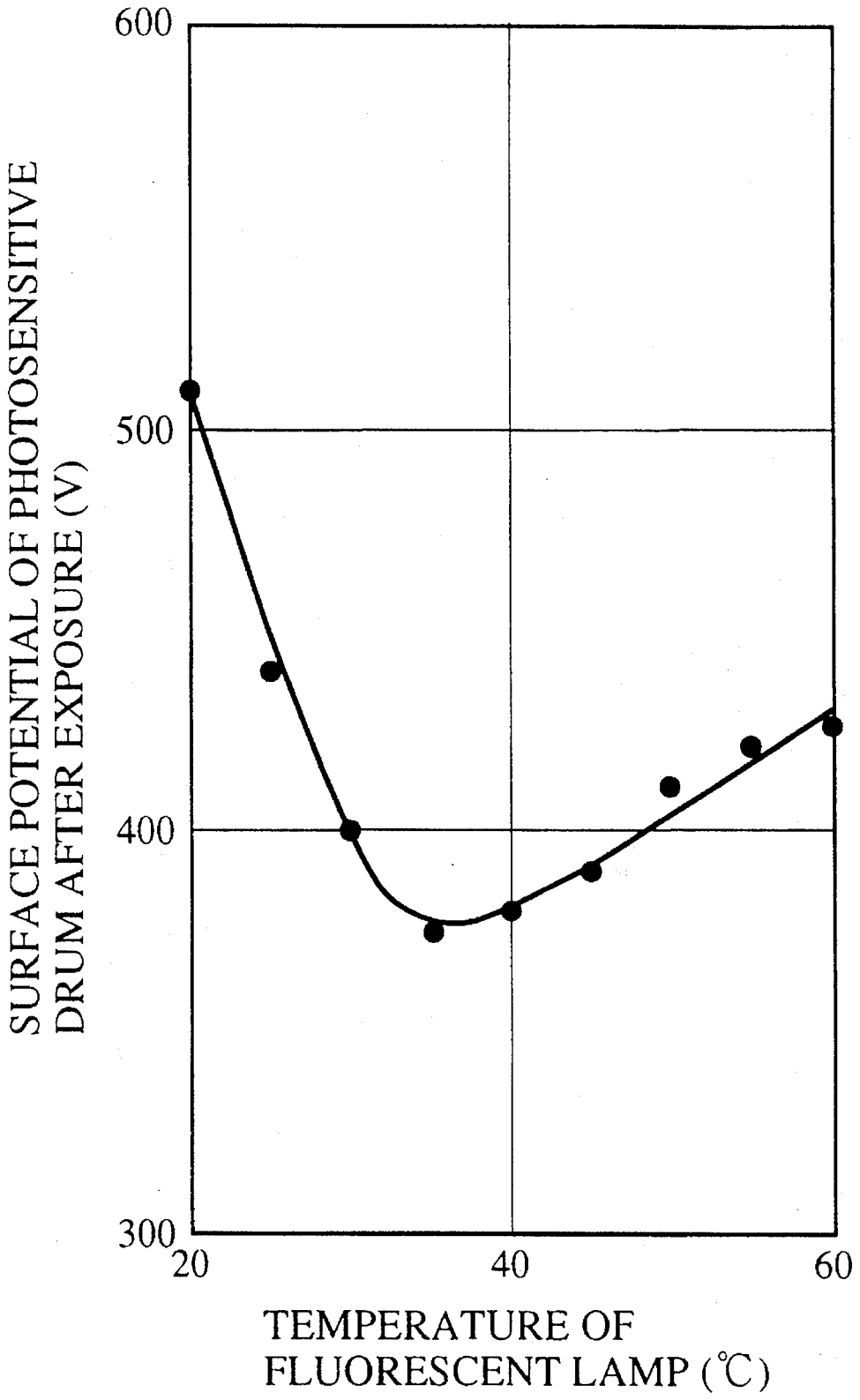
FIG. 10 is a graph of the surface potential characteristics of a photosensitive drum against the temperature of a fluorescent lamp in a case where a gray original is exposed.

FIG. 8 shows the relationship between the temperature of each of the fluorescent lamps 21 and 22 and the illuminance on the surface of the original. FIG. 9 illustrates the relationship between the temperature of each of the fluorescent lamps 21 and 22 in a case where a white original is exposed and the surface potential of the photosensitive drum 1. FIG. 10 illustrates the relationship between the temperature of each of the fluorescent lamps 21 and 22 in a case where a gray original is exposed and the surface potential of the photosensitive drum 1.

As can be seen from FIGS. 8 to 10, the illuminance on the surface of the original by the fluorescent lamps 21 and 22 sensitively varies depending on the change in the temperature of each of the fluorescent lamps 21 and 22. Particularly when the temperature of each of the fluorescent lamps 21 and 22 is low, the illuminance on the surface of the original is insufficient, whereby the surface potential of the photosensitive drum 1 is increased.

In the present embodiment, therefore, the surface-shaped heating elements 26 and 27 respectively affixed to the fluorescent lamps 21 and 22 are driven and controlled on the basis of the temperature sensed by the temperature sensor 28, thereby to keep the temperature of each of the fluorescent lamps 21 and 22 constant.

Furthermore, the duty ratio of drive pulses of the fluorescent lamps 21 and 22 is controlled on the basis of the quantity of light sensed by the light quantity sensor 29, thereby to obtain the most suitable quantity of light.

In the above described embodiment, the optical system for exposure is contained in the sealed casing 10, whereby the optical system for exposure is less affected by the effect of the change in the external temperature and humidity. In addition, dust from the exterior does not enter the sealed casing 10, thereby to make it possible to prevent the adverse effect of the dust.

Figure 11A:
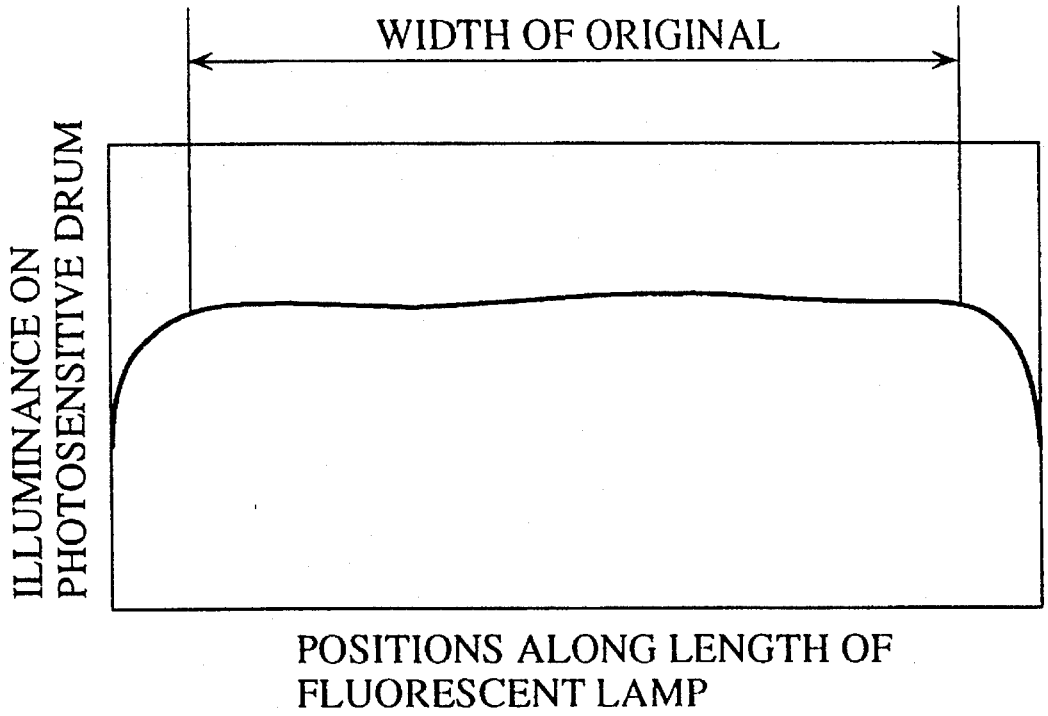
FIG. 11(*a*) and FIG. 11(*b*) are graphs for comparing characteristics relative to the change in the external temperature of a copying machine in which an optical system for exposure is contained in a sealed casing and a copying machine in which an optical system for exposure is not contained in a sealed casing respectively.
Figure 11B:
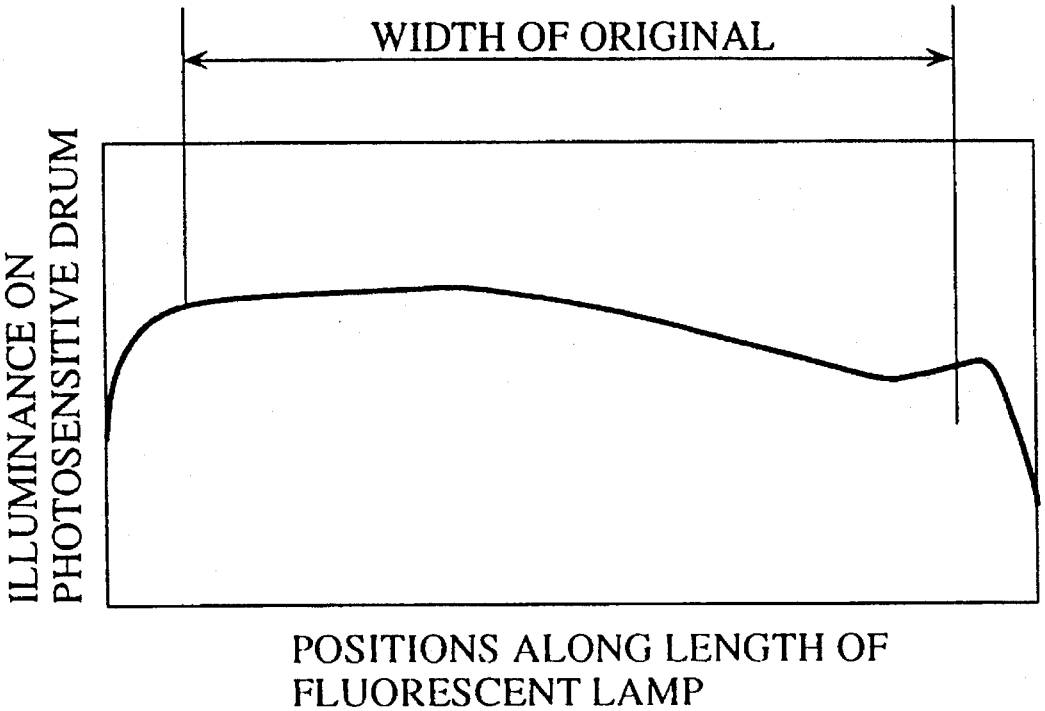

FIG. 11 is a graph of illuminance on the surface of the photosensitive drum against positions along the lengths of fluorescent lamps in both of a copying machine in which the optical system for exposure is contained in the sealed casing 10 and a copying machine in which the optical system for exposure is not contained in the sealed casing immediately after the copying machines are located near an air conditioner and the air conditioner is turned on during continuous copying.

FIG. 11(*a*) shows characteristics with respect to the copying machine in which the optical system for exposure is contained in the sealed casing 10, and FIG. 11(*b*) shows characteristics with respect to the copying machine in which the optical system for exposure is not contained in the sealed casing 10. As can be seen from FIGS. 11(*a*) and 11(*b*), the illuminance on the surface of the photosensitive drum is not constant in positions along the length of the photosensitive drum in the copying machine in which the optical system for exposure is not contained in the sealed casing, while the illuminance on the surface of the photosensitive drum is constant in positions along the length of the photosensitive drum in the copying machine in which the optical system for exposure is contained in the sealed casing. That is, in the copying machine according to the above described embodiment, the change in the illuminance with the external temperature becomes small.

Although in the above described first optical system traveling body 20, two fluorescent lamps are provided, only one fluorescent lamp may be provided, or three or more fluorescent lamps may be provided.

Figure 12:
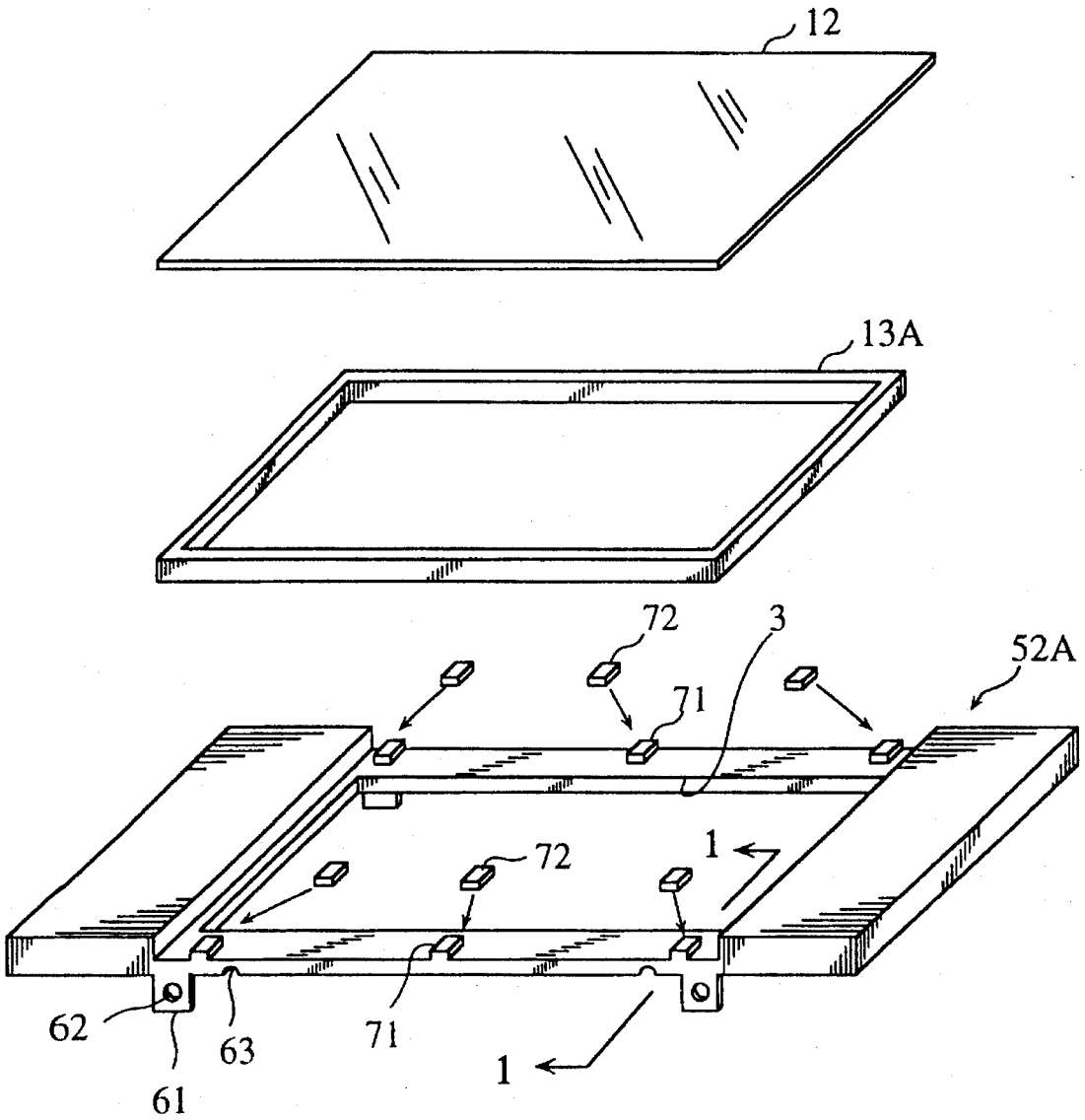
FIG. 12 is an exploded perspective view showing a modified example of the sealed casing.
Figure 13:
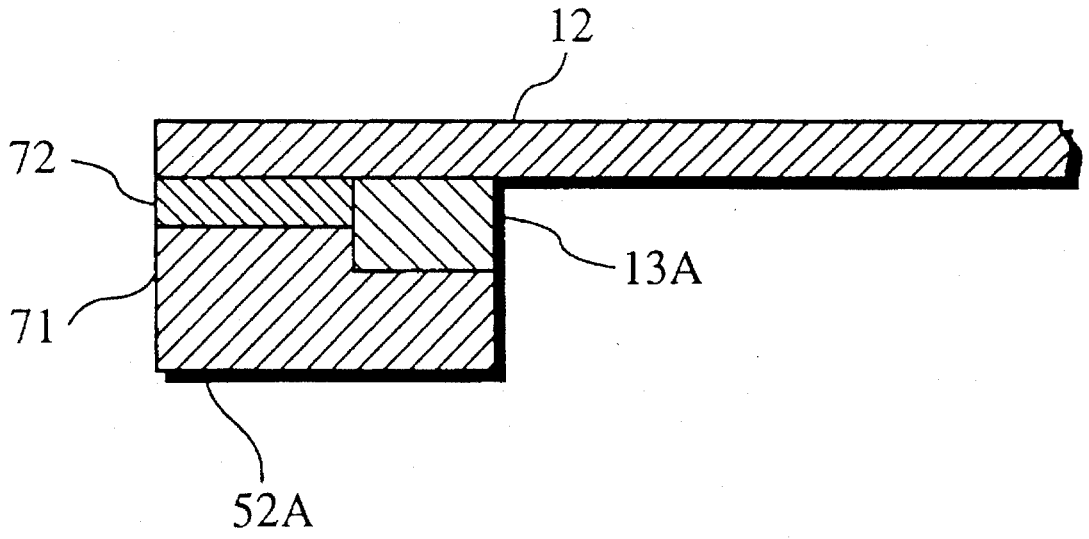
FIG. 13 is an enlarged cross sectional view taken along a line A—A shown in FIG. 12.

FIGS. 12 and 13 illustrate a modified example of the sealed casing 10. In FIG. 12, a case body is the same as that shown in FIG. 2 and hence, the illustration thereof is omitted. In FIG. 12, the same portions as those shown in FIG. 2 are assigned the same reference numerals and hence, the description thereof is not repeated.

The sealed casing is constituted by a case comprising a case body having the same structure as that of the case body 51 shown in FIG. 2 and a cover 52A having a window for exposure 3, a transparent platen 12 mounted on the case in such a manner as to close the window for exposure 3, and a sealing member 13A in a rectangular frame shape which is interposed between the case and a peripheral edge on the lower surface of the transparent platen 12.

Positioning projections 71 for defining the height at which the transparent platen 12 is to be mounted are formed in positions in the center and near both ends of the length on the upper surface of a front frame of a rectangular frame-shaped portion around the window for exposure 3 in the cover 52A. The projections 71 are formed near a front end on the upper surface of the front frame. Positioning projections 71 are also formed in positions in the center and near both ends of the length on the upper surface of a rear frame of the rectangular frame-shaped portion in the cover 52A. The rectangular projections 71 are formed near a rear end on the upper surface of the rear frame. In addition, a rubber plate 72 made of hard rubber is affixed to the upper surface of each of the projections 71. The positioning projections 71 and the rubber plates 72 fixed thereon constitute a height positioning section.

The sealing member 13A in a rectangular frame shape is disposed on the upper surface of the rectangular frame-shaped portion in the cover 52A. In this case, a front frame of the sealing member 13A is disposed in a portion inside (behind) the projection 71 on the upper surface of the front frame in the cover 52A, and a rear frame of the sealing member 13A is disposed in a portion inside (in front of) the projections 71 on the upper surface of the rear frame in the cover 52A.

Furthermore, the transparent platen 12 is disposed on the sealing member 13A and the rubber plates 72. The transparent platen 12 is mounted on the cover 52A in a state where the sealing member 13A is pressed by the transparent platen 12 and the transparent platen 12 is supported on the projections 71 through the rubber plates 72, as shown in FIG. 13, by a fixture (not shown). The cover 52A is fixed to the case body in the same method as that shown in FIG. 2.

Although in the above described example, the rubber plate 72 is affixed to the projection 71, the rubber plate 72 may not be provided.

Figure 14:
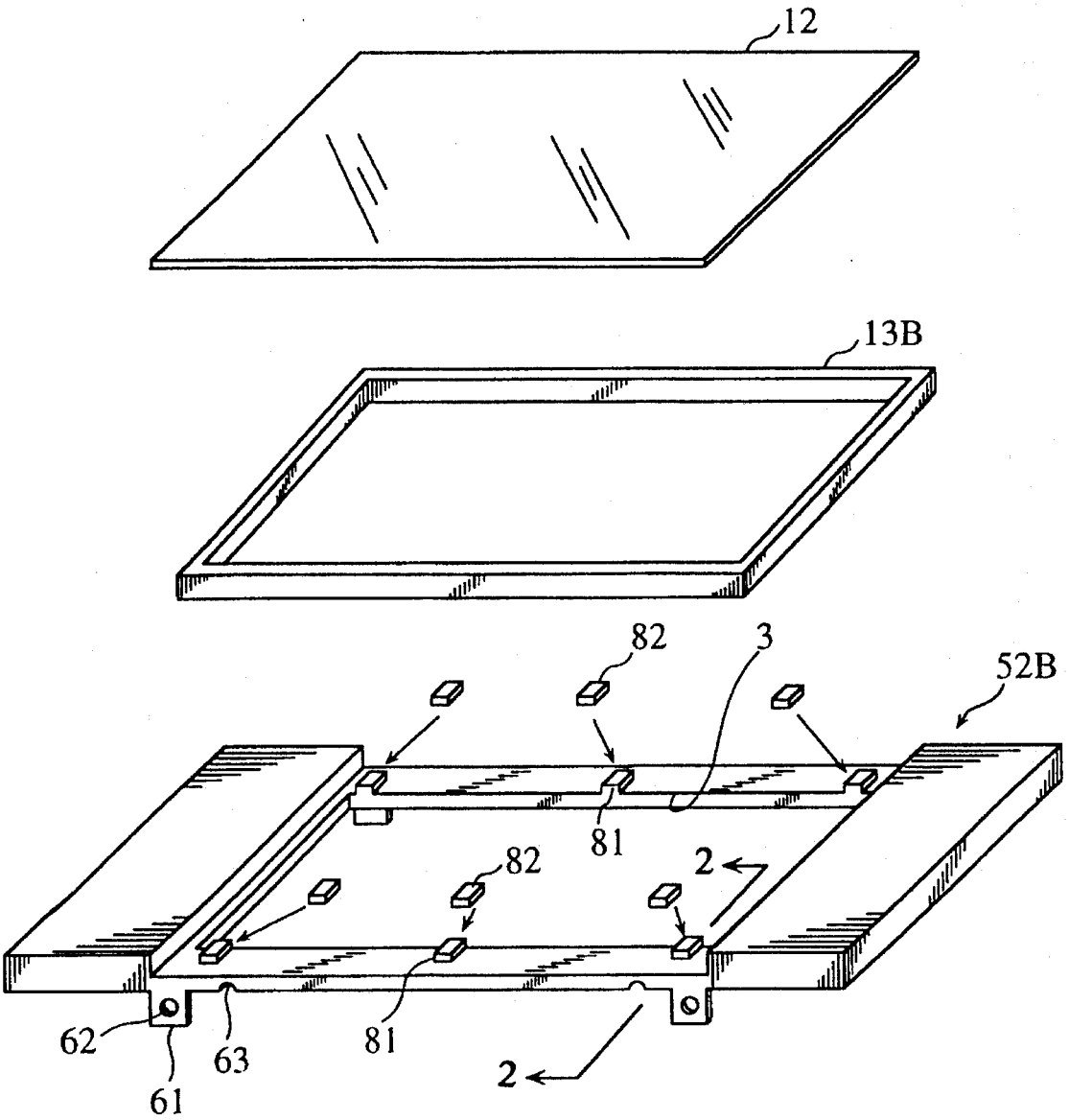
FIG. 14 is an exploded perspective view showing another modified example of the sealed casing.
Figure 15:
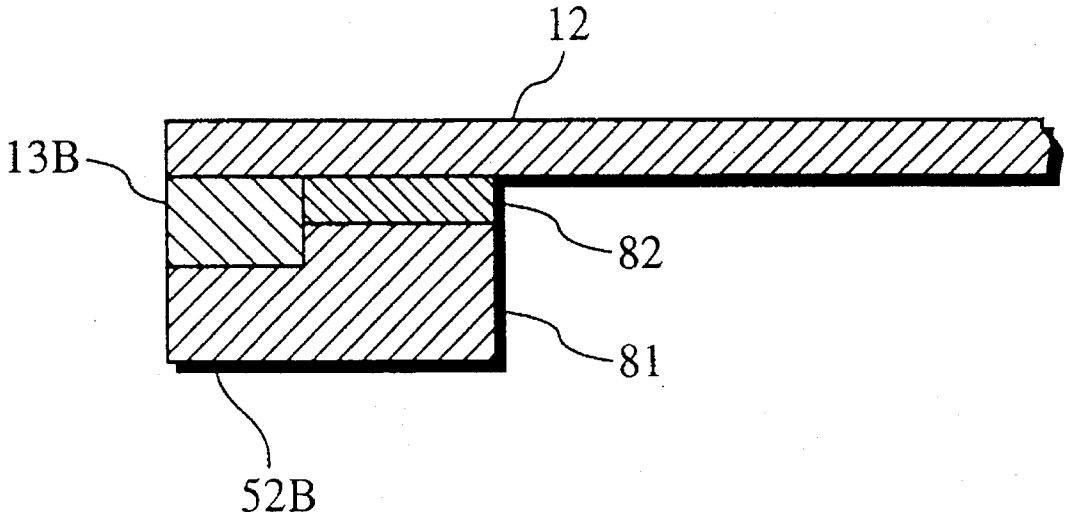
FIG. 15 is an enlarged cross sectional view taken along a line B—B shown in FIG. 14.

FIGS. 14 and 15 illustrate another modified example of the sealed casing 10. The sealed casing is the same as that shown in FIG. 12 except that the positions of positioning projections in a cover and the dimensions of a sealing member differ. In FIG. 14, the same portions as those shown in FIG. 12 are assigned the same reference numerals and hence, the description thereof is not repeated.

Each of rectangular projections for positioning 81 formed on the upper surface of a front frame of a rectangular frame-shaped portion around a window for exposure 3 in a cover 52B is formed near a rear end on the upper surface of the front frame. Each of the positioning projections 81 formed on the upper surface of a rear frame of the rectangular frame-shaped portion in the cover 52B is formed near a front end on the upper surface of the rear frame. A rubber plate 82 is affixed to the upper surface of each of the projections 81.

A sealing member 13B in a rectangular frame shape is disposed on the upper surface of the rectangular frame-shaped portion in the cover 52B. In this case, a front frame of the sealing member 13B is disposed in a portion outside (in front of) the projections 81 on the upper surface of the front frame in the cover 52B, and a rear frame of the sealing member 13B is disposed in a portion outside (behind) the projections 81 on the upper surface of the rear frame in the cover 52B.

Furthermore, a transparent platen 12 is disposed on the sealing member 13B and the rubber plates 82. The transparent platen 12 is mounted on the cover 52B in a state where the sealing member 13B is pressed by the transparent platen 12 and the transparent platen 12 is supported on the projections 81 through the rubber plates 82, as shown in FIG. 15, by a fixture (not shown).

Although in the above described example, the rubber plate 82 is affixed to the projection 81, the rubber plate 82 may not be provided.

Figure 16:
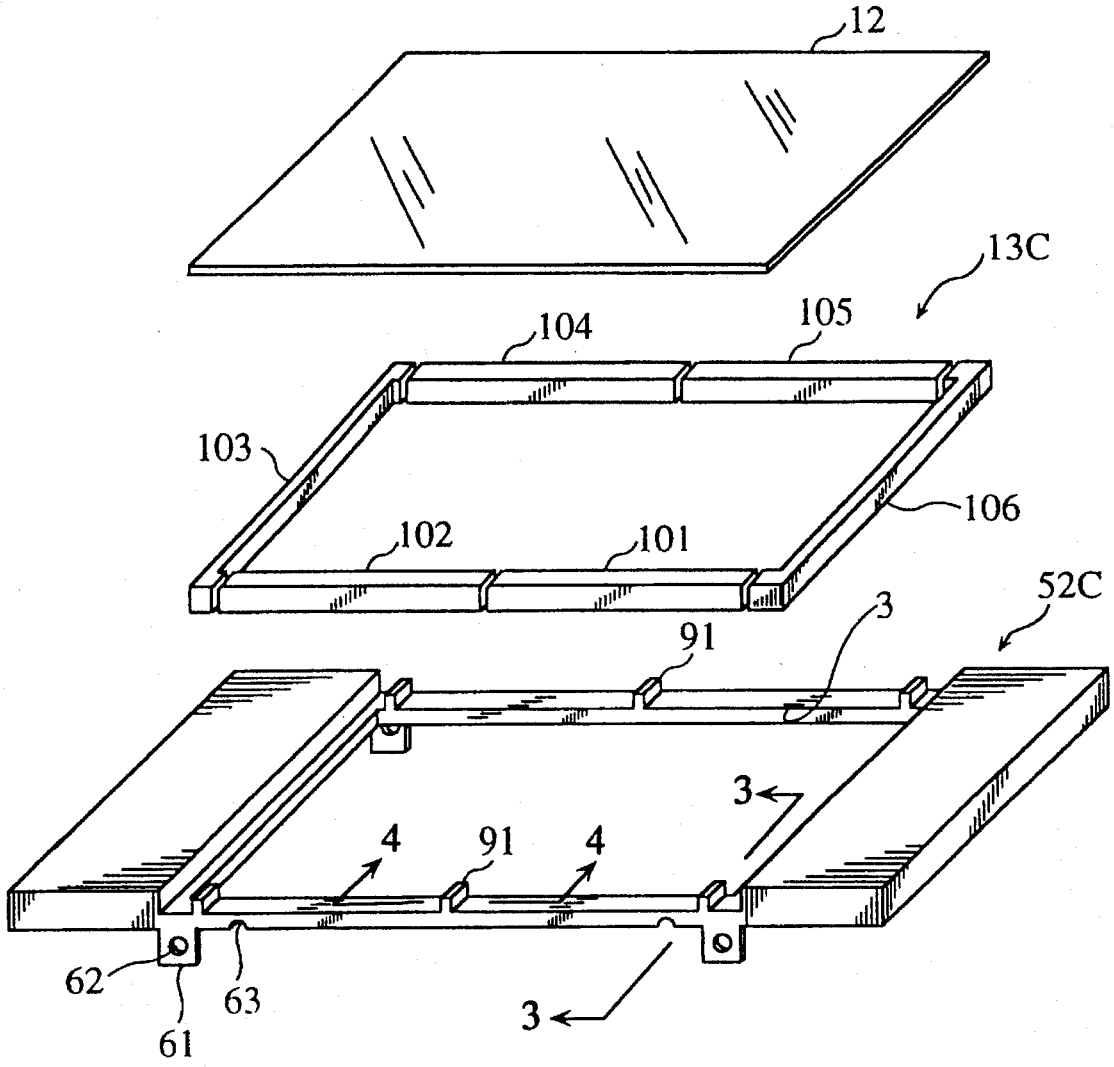
FIG. 16 is an exploded perspective view showing still another modified example of the sealed casing.
Figure 17A:
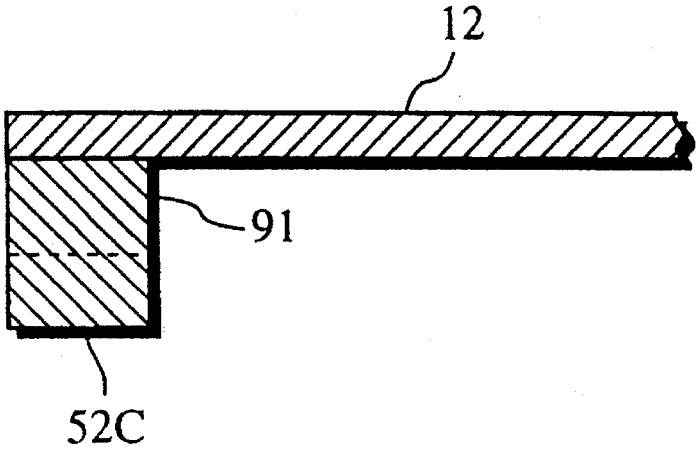
FIG. 17(*a*) and FIG. 17(*b*) are graphs a cross sectional view showing cross section taken along a line C—C shown in FIG. 16 and enlarged cross section taken along a line D—D shown in FIG. 16 respectively.
Figure 17B:
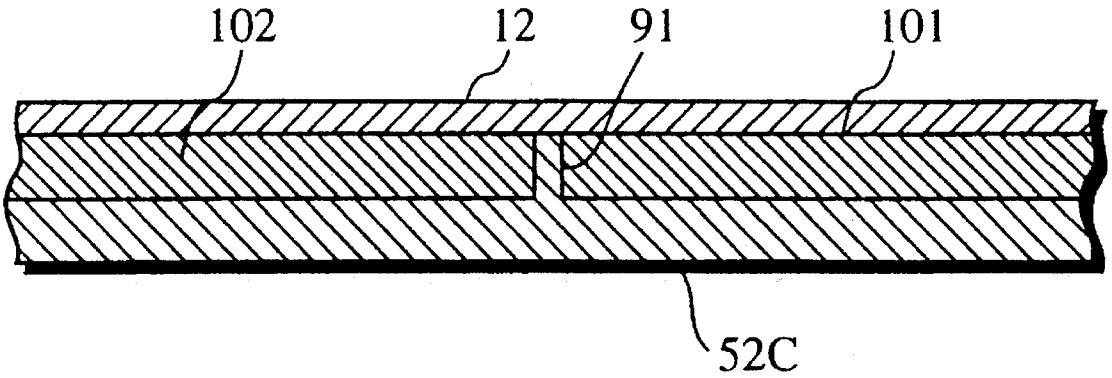

FIGS. 16 and 17 illustrate still another modified example of the sealed casing 10. The sealed casing is the same as that shown in FIG. 12 except that the structures of positioning projections in a cover and a sealing member differ and there are no rubber plates on the positioning projections. In FIG.

16, the same portions as those shown in FIG. 12 are assigned the same reference numerals and hence, the description thereof is not repeated.

Each of positioning projections 91 formed on the upper surface of a front frame of a rectangular frame-shaped portion around a window for exposure 3 in a cover 52C has a length from a front edge to a rear edge on the upper surface the front frame. Similarly, each of positioning projections 91 formed on the upper surface of a rear frame of the rectangular frame-shaped portion in the cover 52C has a length from a front edge to a rear edge on the upper surface of the rear frame.

A sealing member 13C is constituted by six sealing member parts 101 to 106 corresponding to the shapes of portions between the adjacent positioning projections 91 on the upper surface of the rectangular frame-shaped portion in the cover 52C.

The sealing member parts 101 to 106 are respectively fitted in the corresponding portions between the adjacent positioning projections 91 on the upper surface of the rectangular frame-shaped portion in the cover 52C. In addition, a transparent platen 12 is disposed on the sealing member parts 101 to 106 and the positioning projections 91. The transparent platen 12 is mounted on the cover 52C in a state where the sealing member 13C is pressed by the transparent platen 12 and the transparent platen 12 is supported on the projections 91, as shown in FIG. 17, by a fixture (not shown).

Figure 18:
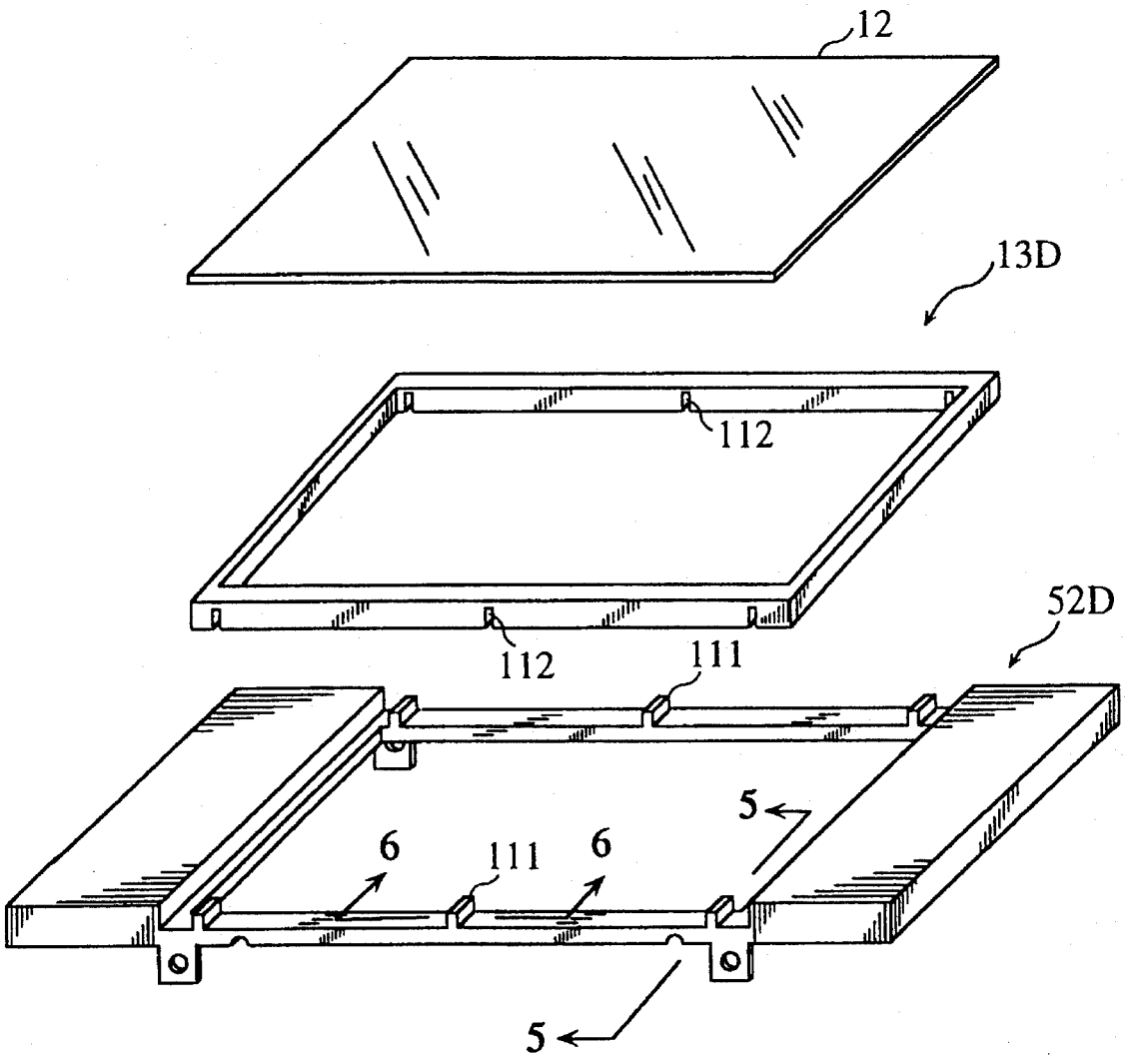
FIG. 18 is an exploded perspective view showing a further modified example of the sealed casing.
Figure 19A:
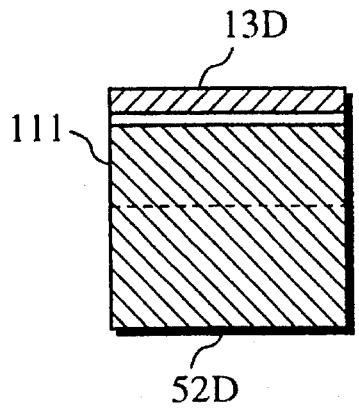
FIGS. 19(*a*) and 19(*b*) depict enlarged cross sectional views showing a cross section taken along a line E—E shown in FIG. 18 and a cross section taken along a line F—F shown in FIG. 18 before a transparent platen is fixed, respectively.
Figure 19B:
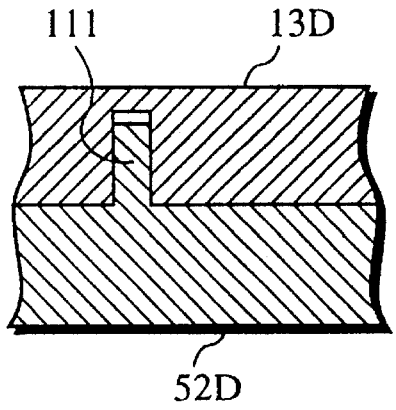
Figure 20A:
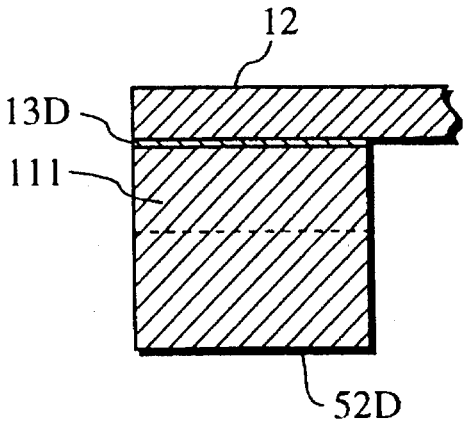
FIGS. 20(*a*) and 20(*b*) depict enlarged cross sectional views showing a cross section taken along a line E—E shown in FIG. 18 and a cross section taken along a line F—F shown in FIG. 18 after a transparent platen is fixed respectively.
Figure 20B:
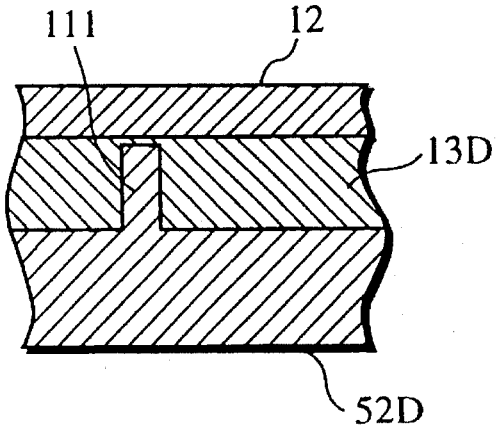

FIGS. 18, 19 and 20 illustrate a further modified example of the sealed casing 10. The sealed casing is the same as that shown in FIG. 12 except that the structures of positioning projections in a cover and a sealing member differ and no thin plates are provided on the positioning projections. In FIG. 18, the same portions as those shown in FIG. 12 are assigned the same reference numerals and hence, the description thereof is not repeated.

Each of positioning projections 111 formed on the upper surface of a front frame of a rectangular frame-shaped portion around a window for exposure 3 in a cover 52D has a length from a front edge to a rear edge on the upper surface of the front frame. Similarly, each of positioning projections 111 formed on the upper surface of a rear frame of the rectangular frame-shaped portion in the cover 52D has a length from a front edge to a rear edge on the upper surface of the rear frame.

A sealing member 13D is in the same rectangular frame shape as that of the rectangular frame-shaped portion in the cover 52D. Notches 112 in a groove shape in which the positioning projections 111 are to be fitted are formed in portions corresponding to the positioning projections 111 on the lower surface of the sealing member 13D. The width of each of the notches 112 is made slightly smaller than the thickness of each of the positioning projections 111.

The sealing member 13D is disposed on the upper surface of the rectangular frame-shaped portion in the cover 52D in such a manner that the corresponding positioning projections 111 are respectively fitted in the notches 112. Cross section taken along a line E—E and cross section taken along a line F—F in this state are illustrated in FIGS. 19(*a*) and 19(*b*). In addition, a transparent platen 12 is disposed on the sealing member 13D. The transparent platen 12 is mounted on the cover 52D in a state where the sealing member 13D is pressed by the transparent platen 12 and the transparent platen 12 is supported on the positioning projections 111 through the sealing member 13D by a fixture (not shown). Cross section taken along a line E—E and cross section taken along a line F—F in this state are illustrated in FIGS. 20(*a*) and 20(*b*).

Figure 21:
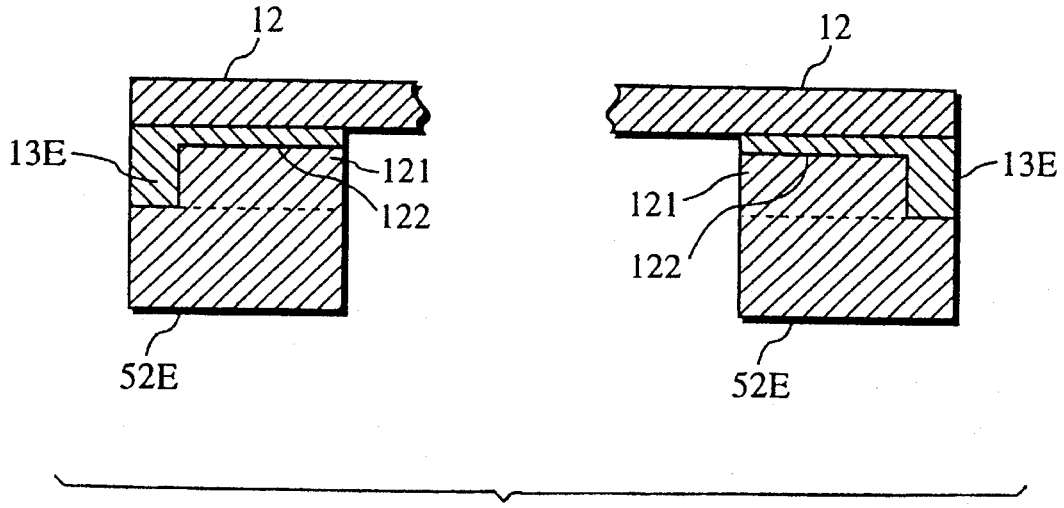
FIG. 21 is a cross sectional view showing a modified example of a cover and a sealing member in the sealed casing shown in FIG. 18.

As shown in FIG. 21, positioning projections 121 may be formed with portions near outer peripheral edges on the upper surfaces of a front frame and a rear frame of a rectangular frame-shaped portion in a cover 52E being left to respectively form notches 122 in which the positioning projections 121 are to be fitted in positions corresponding to the positioning projections 121 in a sealing member 13E.

Figure 22:
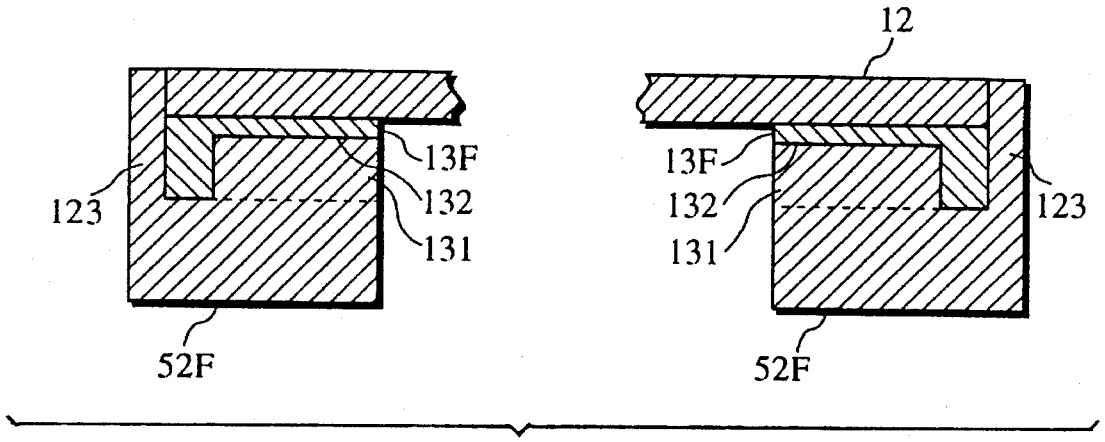
FIG. 22 is a cross sectional view showing another modified example of a cover and a sealing member in the sealed casing shown in FIG. 18.

Furthermore, as shown in FIG. 22, rising walls 123 may be formed on the side of outer peripheral edges on the upper surfaces of a front frame and a rear frame of a rectangular frame-shaped portion in a cover 52F and positioning projections 131 may be formed with portions near the rising walls 123 on the upper surfaces of the front frame and the rear frame of the rectangular frame-shaped portion in the cover 52F being left to respectively form notches 132 in which the positioning projections 131 are to be fitted in positions corresponding to the positioning projections 131 in a sealing member 13F.

Figure 23:
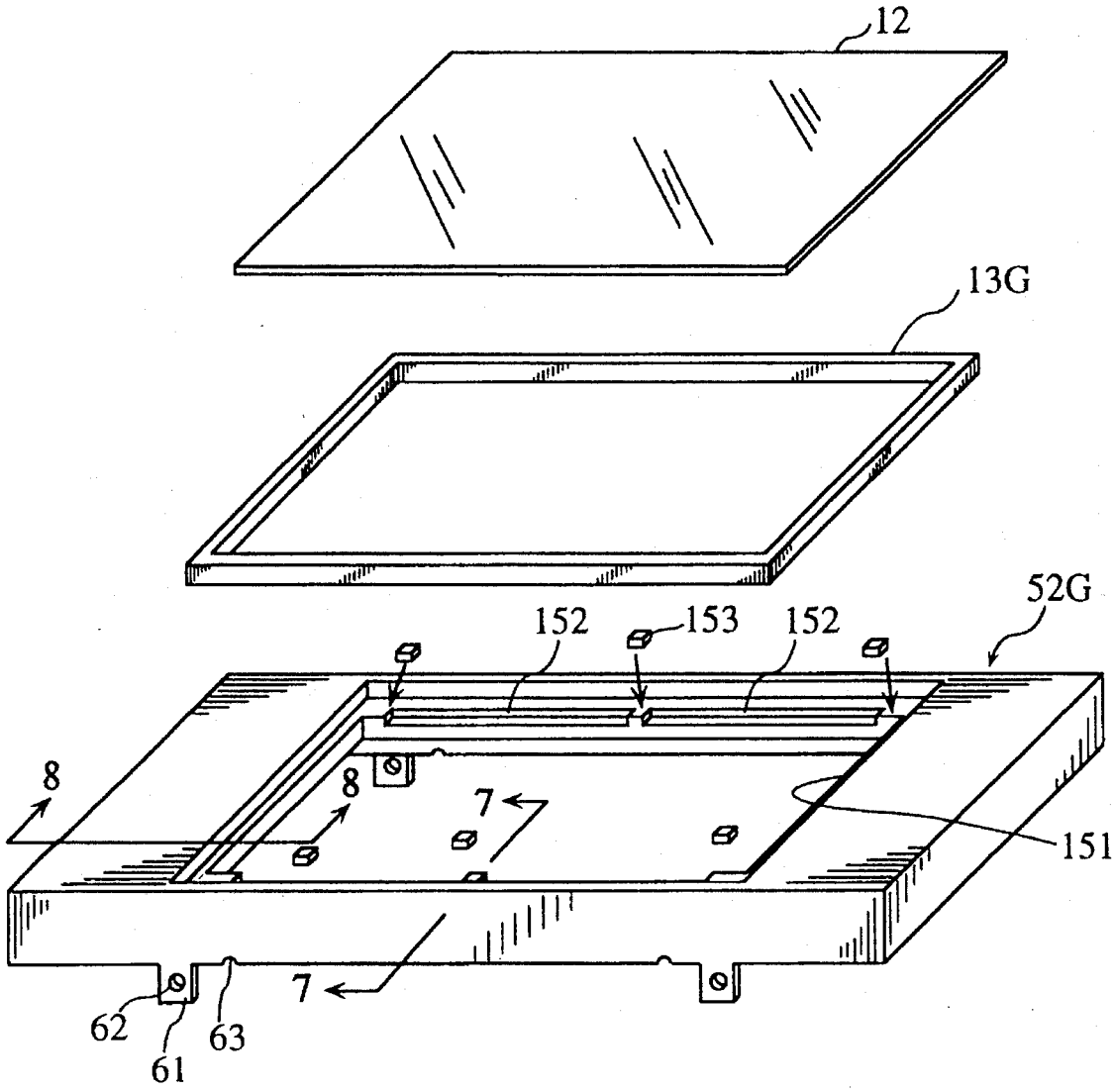
FIG. 23 is an exploded perspective view showing a still further modified example of the sealed casing.
Figure 24:
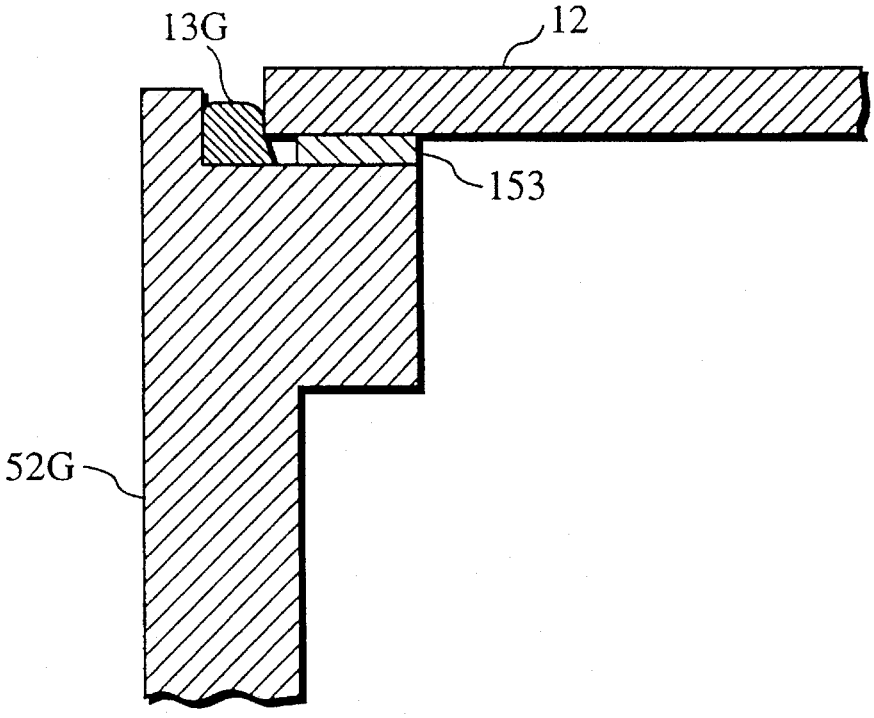
FIG. 24 is an enlarged cross sectional view taken along a line G—G shown in FIG. 23.
Figure 25:
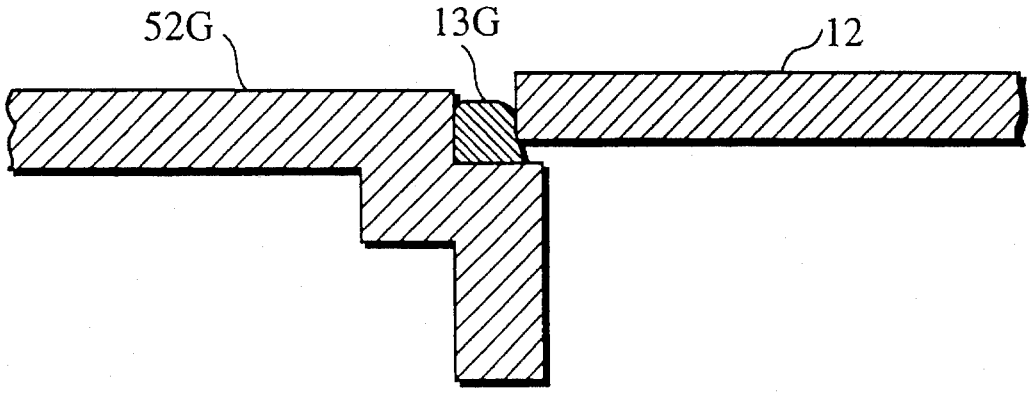
FIG. 25 is an enlarged cross sectional view taken along a line H—H shown in FIG. 23.

FIGS. 23, 24 and 25 illustrate a still further modified example of the sealed casing 10. The sealed casing is the same as that shown in FIG. 12 except that the structures of a cover and a sealing member differ. In FIG. 23, the same portions as those shown in FIG. 12 are assigned the same reference numerals and hence, the description thereof is not repeated.

A recess 151 is formed on the upper surface of a cover 52G, and a window for exposure 3 is provided on the bottom surface of the recess 151. Consequently, the bottom surface of the recess 151 is in a rectangular frame shape. Edges on the side of the window for exposure 3 on the upper surfaces of a front frame and a rear frame of the rectangular frame-shaped portion are cut away with the center and both right and left ends along their lengths being left. The cut-away portions are represented by reference numeral 152. Rubber plates 153 are respectively affixed to the center and both right and left ends along the lengths of the edges on the side of the window for exposure 3 on the upper surfaces of the front frame and the rear frame of the rectangular frame-shaped portion.

A sealing member 13G in a rectangular frame shape is fitted in the recess 151 of the cover 52G and is fixed thereto, after which the transparent platen 12 is fitted in the recess 151. The transparent platen 12 is mounted on the cover 52G in a state where the sealing member 13G is pressed by the transparent platen 12 and the transparent platen 12 is supported on the rubber plates 153 on the rectangular frame-shaped portion in the cover 52G.

Figure 26:
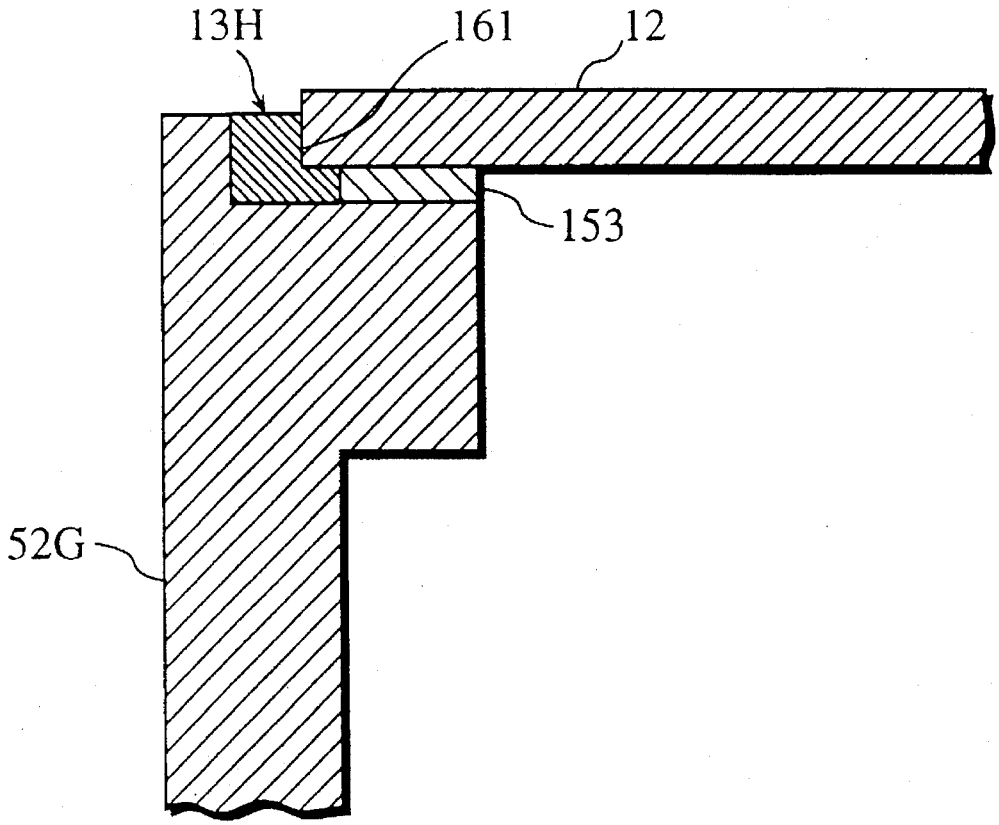
FIG. 26 is a cross sectional view showing a modified example of a sealing member in the sealed casing shown in FIG. 23.
Figure 27:
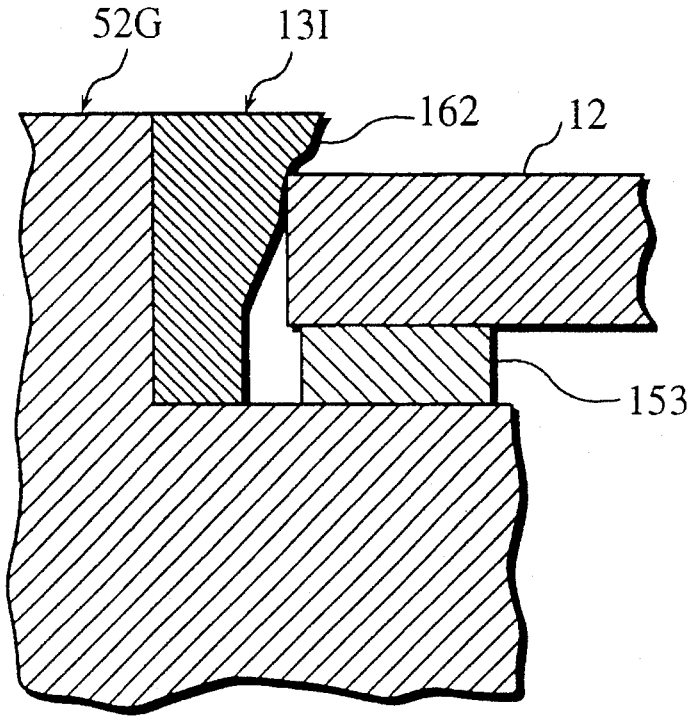
FIG. 27 is a cross sectional view showing another modified example of the sealing member in the sealed casing shown in FIG. 23.
Figure 28:
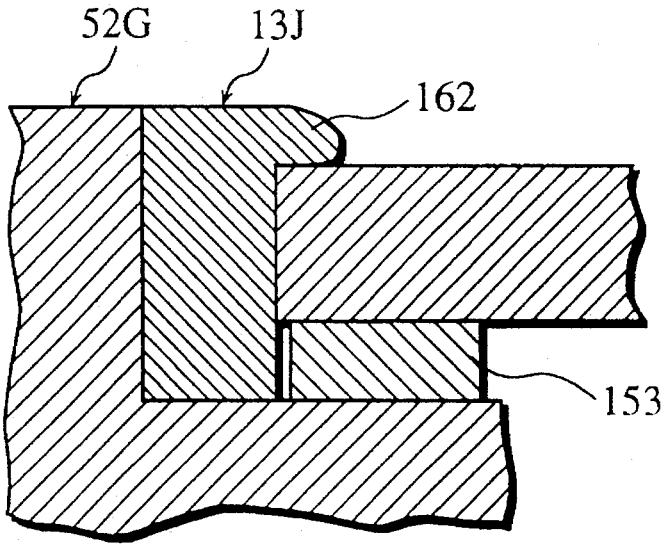
FIG. 28 is a cross sectional view showing still another modified example of the sealing member in the sealed casing shown in FIG. 23.

The above described sealing member 13G may be replaced with a sealing member 13H in an L shape in cross section having a notch 161 in which an outer peripheral edge of the transparent platen 12 is to be fitted formed over its entire periphery, as shown in FIG. 26. In addition, the above described sealing member 13G may be replaced with a sealing member 13I having an inclined surface 162 having a width increased upward on its inner peripheral surface, as shown in FIG. 27. Further, the above described sealing member 13G may be replaced with a sealing member 13J having a glass pressing section 162 in an inward projected shape formed in the upper end on its inner peripheral surface, as shown in FIG. 28.

Examples of the sealing members 13 and 13A to 13J used in the above described embodiment and the modified examples include one made of sponge, one in which a skin layer which is a resin layer of the same material as sponge is formed around a core made of sponge, one made of rubber, and one in which a resin sheet is affixed to the periphery of a core made of sponge. In addition, as the sealing members 13 and 13A to 13F, one in which tongue-shaped projections are formed on a surface receiving a transparent platen 12 may be used.

Figure 29:
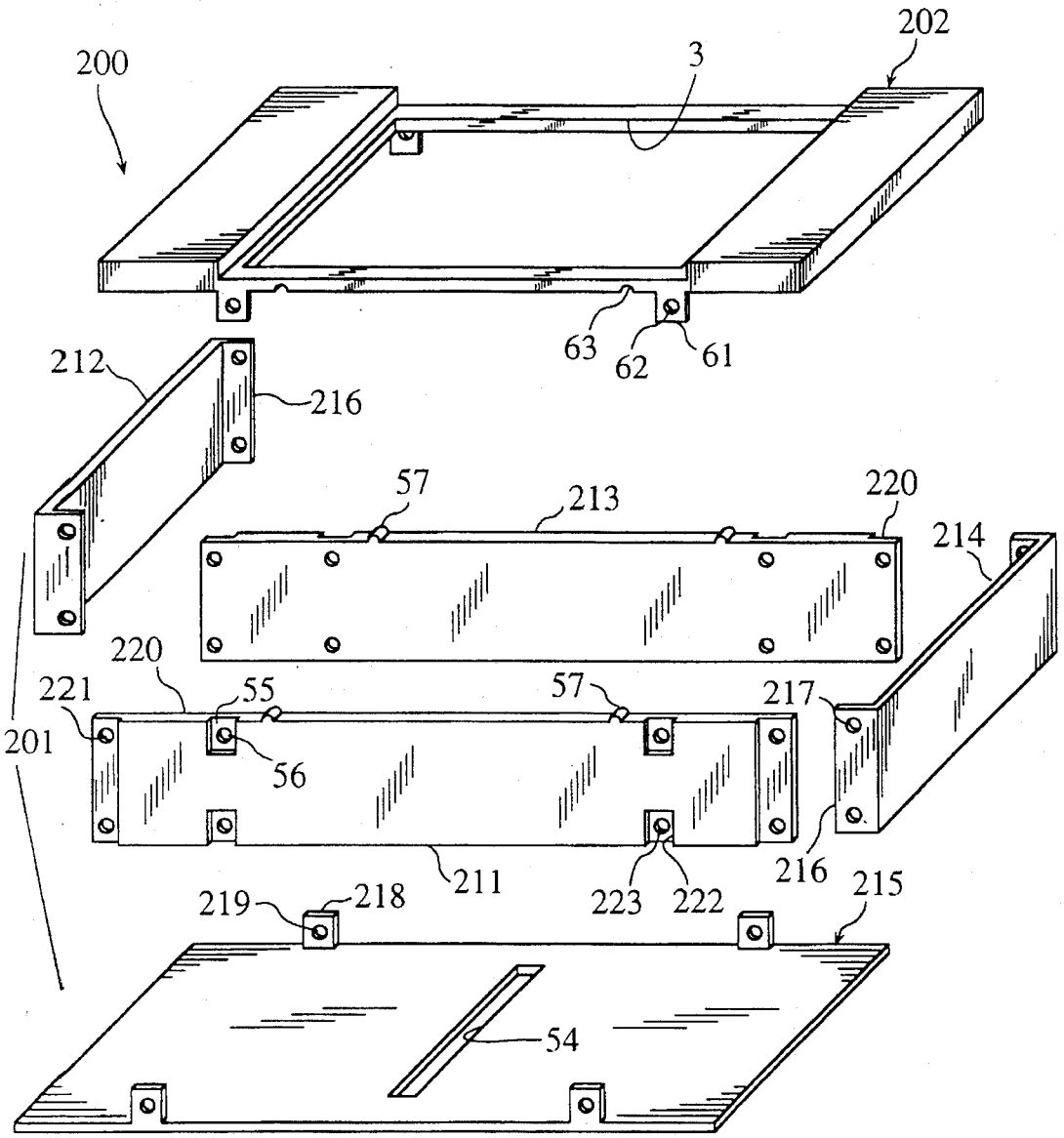
FIG. 29 is an exploded perspective view showing a modified example of the case shown in FIG. 2.

FIG. 29 illustrates a modified example of the case 11 shown in FIG. 2 in the above described embodiment. In FIG. 29, the same portions as those shown in FIG. 2 are assigned the same reference numerals and hence, the description thereof is not repeated.

In a case 200, a cover 202 is the same as that shown in FIG. 2, and a case body 201 differs from that shown in FIG. 2. Specifically, the case body 201 is constituted by four side plates 211 to 214 and a bottom 215. Brackets 216 projected inward are integrally formed in both ends of each of the right and left side plates 212 and 214. Each of the brackets 216 is provided with a pair of upper and lower screw insertion holes 217.

Furthermore, two brackets 218 projected upward are integrally formed in each of front and rear ends on the upper surface of the bottom 215. Each of the brackets 218 is also provided with a screw insertion hole 219.

Notches in which the brackets 216 of the left side plate 212 are to be fitted are respectively formed in left ends on the outer surfaces of the front side plate 211 and the rear side plate 213, thereby to form a connecting portion 220. In addition, notches in which the brackets 216 of the right side plate 214 are to be fitted are respectively formed in right ends on the outer surfaces of the front side plate 211 and the rear side plate 213, thereby to form a connecting portion 220. Each of the connecting portions 220 is provided with a pair of upper and lower screw holes 221.

Notches 222 in which the brackets 216 are to be fitted are respectively formed in positions corresponding to the brackets 218 in the bottom 215 in lower ends on the outer surfaces of the front side plate 211 and the rear side plate 213. Screw holes 223 are respectively formed in portions where the notches 222 are formed in the lower ends on the outer surfaces of the front side plate 211 and the rear side plate 213.

The brackets 216 of the left side plate 212 are combined with the connecting portion 220 in the left ends of the front side plate 211 and the rear side plate 213, after which screws are respectively gotten into the screw holes 221 from the screw insertion holes 217 to be tightened, thereby to connect the left side plate 212 to the front side plate 211 and the rear side plate 213. Similarly, the brackets 216 of the right side plate 214 are combined with the connecting portion 220 in the right ends of the front side plate 211 and the rear side plate 213, after which screws are respectively gotten into the screw holes 221 from the screw insertion holes 217 to be tightened, thereby to connect the right side plate 212 to the front side plate 211 and the rear side plate 213.

Additionally, the corresponding brackets 218 of the bottom 215 are fitted in the notches 222 in the front side plate 211 and the rear side plate 213, after which screws are respectively gotten into the screw holes 223 from the screw insertion holes 219 to be tightened, thereby to connect the bottom 215 to the front side plate 211 and the rear side plate 213.

The cover 202 is fixed to the case body 201 thus assembled in the same method as the method explained in FIG. 2.

Figure 30:
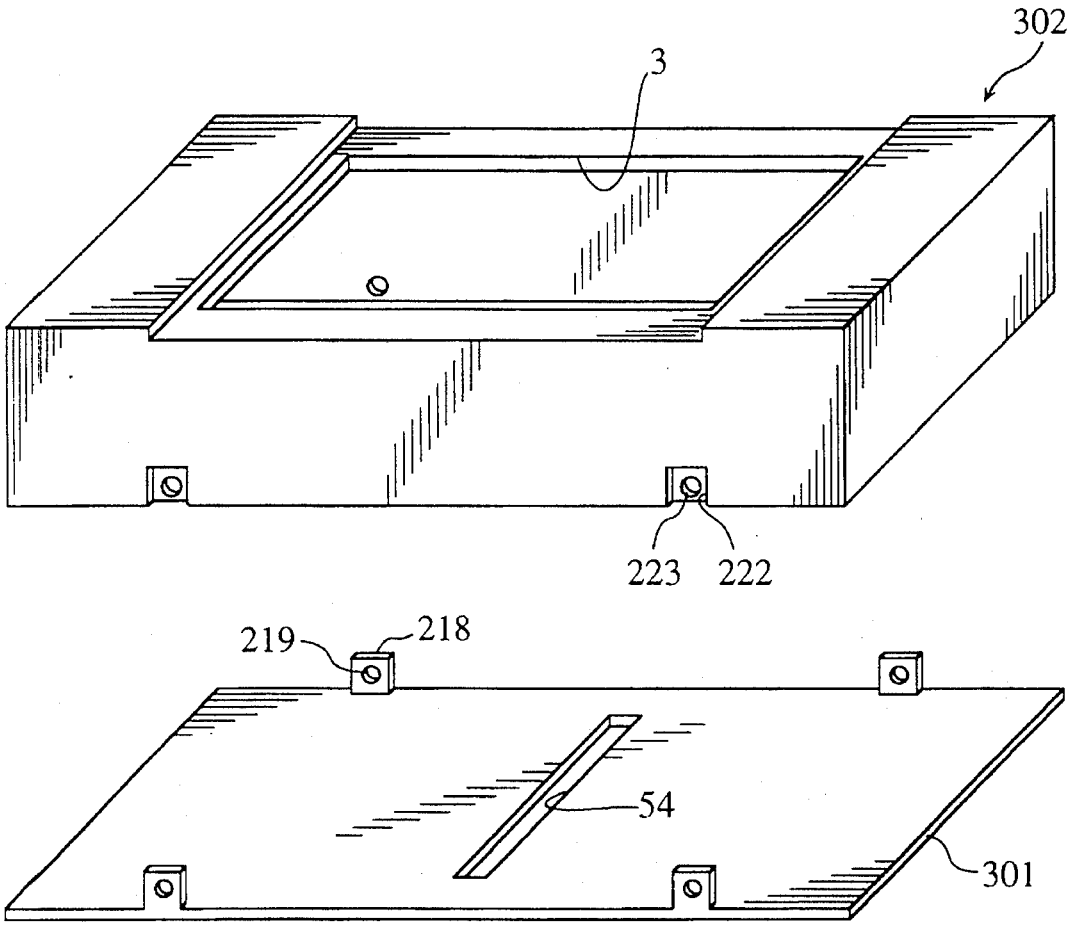
FIG. 30 is an exploded perspective view showing another modified example of the case shown in FIG. 2.

FIG. 30 illustrates a modified example of the case shown in FIG. 2 in the above described embodiment. The case shown in FIG. 2 is constituted by a case body opening upward and a cover, while a case 300 shown in FIG. 30 is constituted by a bottom 301 and a case body 302 having a window for exposure 3 on its upper surface and opening downward. The bottom 301 is fixed to the case body 302 in the same method as the method described in FIG. 29.

Figure 31:
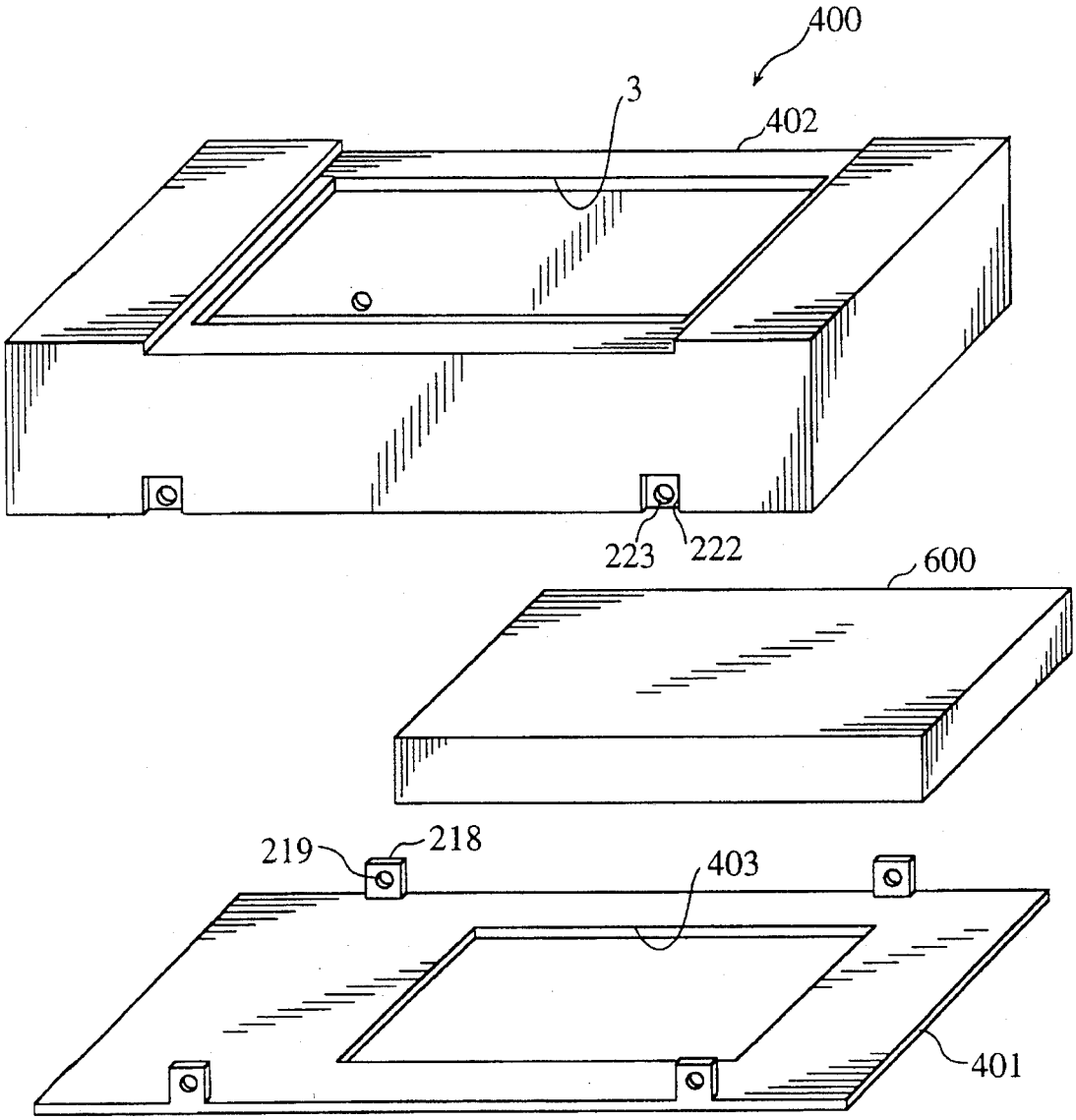
FIG. 31 is an exploded perspective view showing a further modified example of the case shown in FIG. 2.
Figure 32:
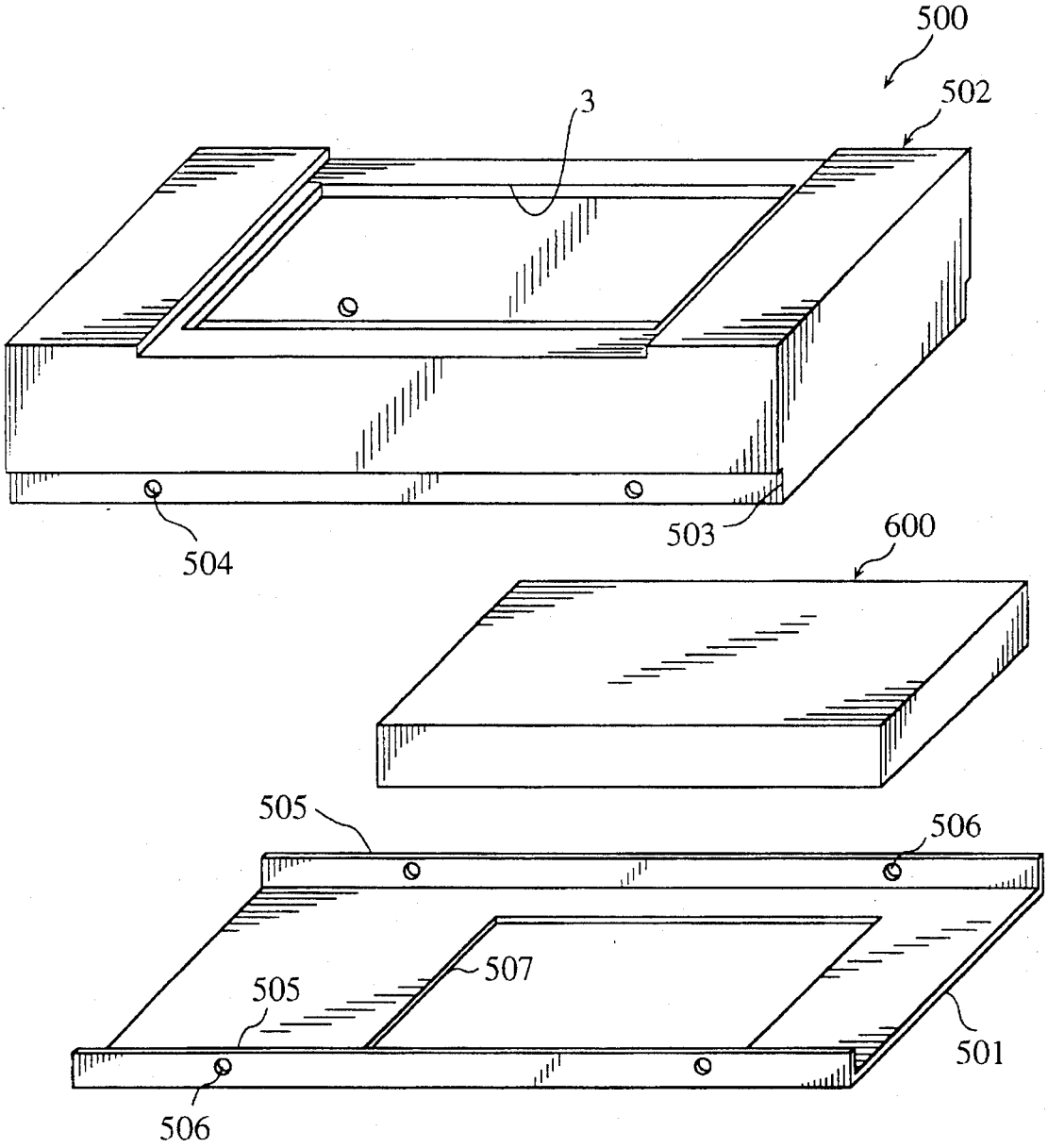
FIG. 32 is an exploded perspective view showing a still further modified example of the case shown in FIG. 2.

FIGS. 31 and 32 respectively illustrate other modified examples of the case 11 shown in FIG. 2 in the above described embodiment. The cases are used particularly when a lens unit 40 is contained in a lens unit case 600. A slit for light input (not shown) for introducing light from the second optical system traveling body 30 is provided in a left end surface of the lens unit case 600. In addition, a slit for light output (not shown) for introducing light reflected by the sixth mirror 44 (see FIG. 1) into the photosensitive drum 1 is provided on the lower surface of the lens unit case 600. The slit for light output is closed by a glass plate (not shown).

A case 400 shown in FIG. 31 is constituted by a bottom 401 and a case body 402 having a window for exposure 3 on its upper surface and opening downward. A rectangular hole 403 smaller than the bottom surface of the lens unit case 600 is provided in the bottom 401. The lens unit case 600 is disposed and fixed on the bottom 401 so as to close the hole 403. The bottom 401 is fixed to the case body 402 in the same method as the method described in FIG. 30.

A case 500 shown in FIG. 32 is constituted by a bottom 501 and a case body 502 having a window for exposure 3 on its upper surface and opening downward. Notches 503 are formed over the entire lengths of lower ends on the outer surfaces of front and rear sidewalls of the case body 502. A pair of right and left screw holes 504 is formed in a portion where each of the notches 503 on the front and rear sidewalls of the case body 502 is formed.

Rising walls 505 are integrally formed in front and rear edges of the bottom 501. Screw insertion holes 506 are respectively formed in positions corresponding to the screw holes 504 of the case body 502 in the respective rising walls 505. Further, a rectangular hole 507 smaller than the bottom surface of the lens unit case 600 is provided in the bottom 501. The lens unit case 600 is disposed on the bottom 501 so as to close the hole 507.

The rising walls 505 of the bottom 501 are respectively fitted in the notches 503 of the case body 502, after which screws are respectively gotten into the screw holes 504 from the screw insertion holes 506 to be tightened, thereby to connect the bottom 501 to the case body 502.

As the copying machine, a copying machine of an original platen fixed type comprising a first optical system traveling body having a first optical system including an exposure lamp for irradiating an original by light and a first mirror for reflecting light reflected from the original in a predetermined direction and a second optical system traveling body having a second optical system including second and third mirrors for introducing light reflected by the first mirror in the first optical system traveling body in a predetermined direction has been known.

In this type of copying machine, the first optical system traveling body and the second optical system traveling body are moved by a wire driving mechanism. Specifically, the first optical system traveling body is attached to wire of the wire driving mechanism. On the other hand, the second optical system traveling body is attached to the wire through a pulley rotatably mounted on the second optical system traveling body. As the wire is moved, the first and second optical system traveling bodies are moved.

The focus of an image varies depending on the mounting position of the first optical system traveling body on the wire. Consequently, the mounting position of the first optical system traveling body on the wire is adjusted, thereby to adjust the focus of the image. In other words, the first optical system traveling body is attached to the wire in the position where the image is focused.

The optical systems such as the first optical system and the second optical system have been contaminated by dust or the like with the elapse of time. A service man cleans the optical systems periodically.

A reflecting plate is provided in addition to the exposure lamp, the first mirror and the like in the first optical system traveling body. Since the shape of the reflecting plate is complicated and the size of the first mirror is small, it is difficult to clean them from above the first optical system traveling body. That is, it is difficult to clean the reflecting plate and the first mirror in a state where the first optical system traveling body is mounted on the wire.

It is considered that the first optical system traveling body is detached from the wire to clean the reflecting plate and the first mirror. However, this brings about the necessity of adjusting the focus of an image when the first optical system traveling body is mounted on the wire again after cleaning the optical systems. However, the adjustment of the focus of the image is not easy and takes a lot of time and labor. Such a problem occurs also when the exposure lamp is replaced.

The applicant of the present invention has developed an electrophotographic copying machine in which the focus of an image may not be adjusted in detaching the first optical system traveling body from the wire of the wire driving mechanism, and then attaching the first optical system traveling body to the wire again. The entire construction of the electrophotographic copying machine is the same as that shown in FIG. 1 and hence, the description thereof is not repeated.

Figure 33:
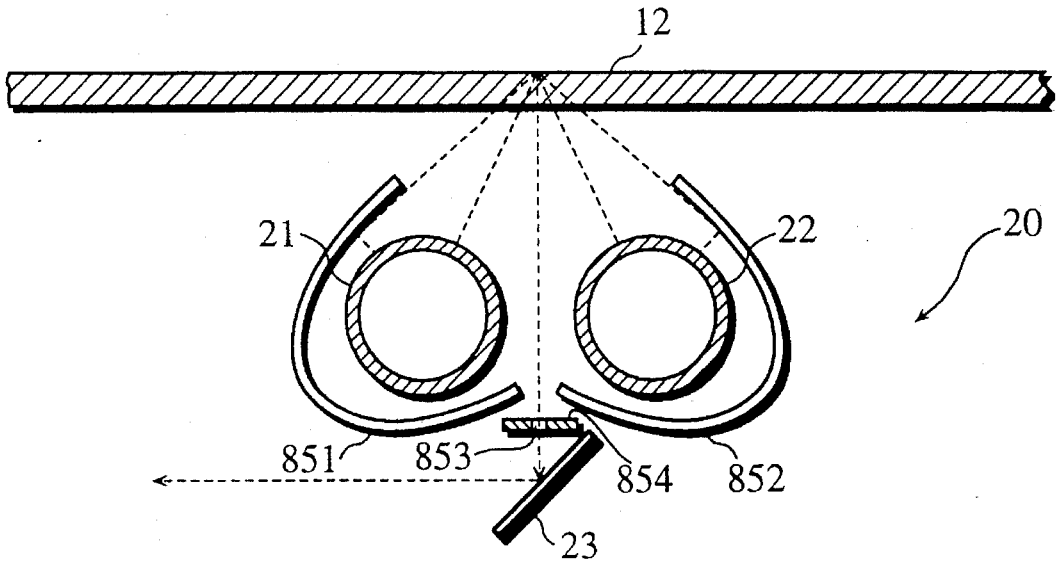
FIG. 33 is a transverse sectional view showing another example of a first optical system traveling body.

FIG. 33 illustrates the detailed construction of the first optical system traveling body 20.

The first optical system traveling body 20 comprises, in addition to a pair of exposure lamps 21 and 22, a first mirror 23 and the like, reflecting plates 851 and 852 for efficiently introducing light emitted from the exposure lamps 21 and 22 to an original and a slit plate 854 provided on the path of incidence of light reflected from the original into the first mirror 23 and having a slit 853. The exposure lamps 21 and 22, the first mirror 23, the reflecting plates 851 and 852, and the slit plate 854 constitute a first optical system. In this example, a fluorescent lamp is used as the exposure lamps 21 and 22. Although in the above described first optical system traveling body 20, two exposure lamps are provided, only one exposure lamp may be provided, or three or more exposure lamps may be provided.

The light emitted from each of the exposure lamps 21 and 22 is irradiated toward the original on a transparent platen 12 through the transparent platen 12. Light reflected by the original is incident on the first mirror 23 through the transparent platen 12 and the slit 853. The light incident on the first mirror 23 is reflected by the first mirror 23 to the second optical system traveling body 30.

Figure 34:
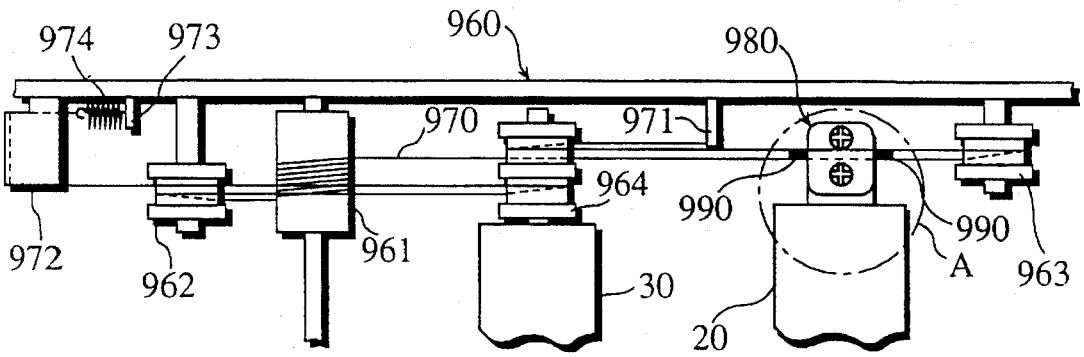
FIG. 34 is a plan view showing a wire driving mechanism.
Figure 35:
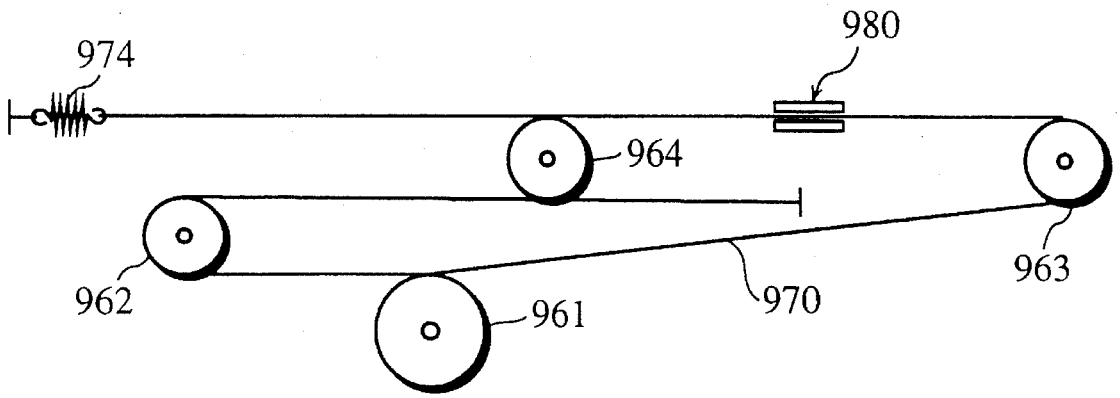
FIG. 35 is a front view showing the wire driving mechanism.
Figure 36:
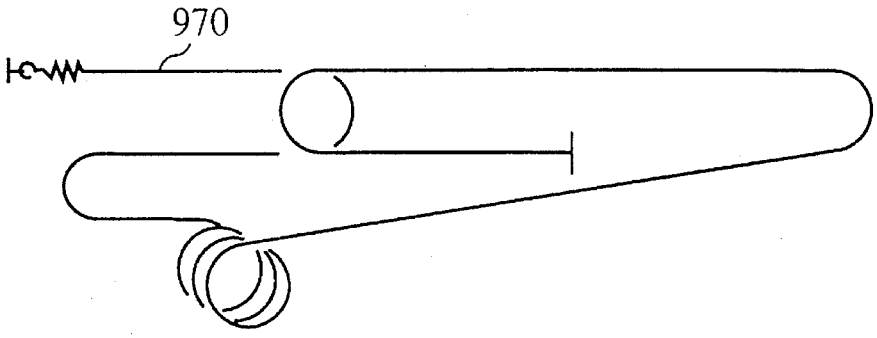
FIG. 36 is a perspective view showing a path of wire of the wire driving mechanism.

FIGS. 34, 35 and 36 illustrate wire driving mechanisms for moving the first optical system traveling body 20 and the second optical system traveling body 30. Although the wire driving mechanisms shown in FIGS. 35 and 36 are provided on both sides with the first optical system traveling body 20 and the second optical system traveling body 30 interposed therebetween, both the wire driving mechanisms have the same structure and hence, only the wire driving mechanism on one side will be described.

First, second and third pulleys 961, 962 and 963 are rotatably mounted on a mounting frame 960 in the wire driving mechanism. The first pulley 961 is rotated by a scan motor (not shown). A fourth pulley 964 is rotatably mounted on an end of the second optical system traveling body 30.

One end of wire 970 is fixed to a wire fixture 971 formed in the frame 960. The wire 970 extending from the wire fixture 971 is wound around the fourth pulley 964 and the third pulley 963, and then wound around the first pulley 961 a plurality of number of times. The wire 970 wound around the first pulley 961 is further wound around the second pulley 962 and the fourth pulley 964, and then is connected to a wire fixture 973 provided in the frame 960 through a guiding member 972 provided in the frame 960 through a helical tension spring 974.

Figure 37:
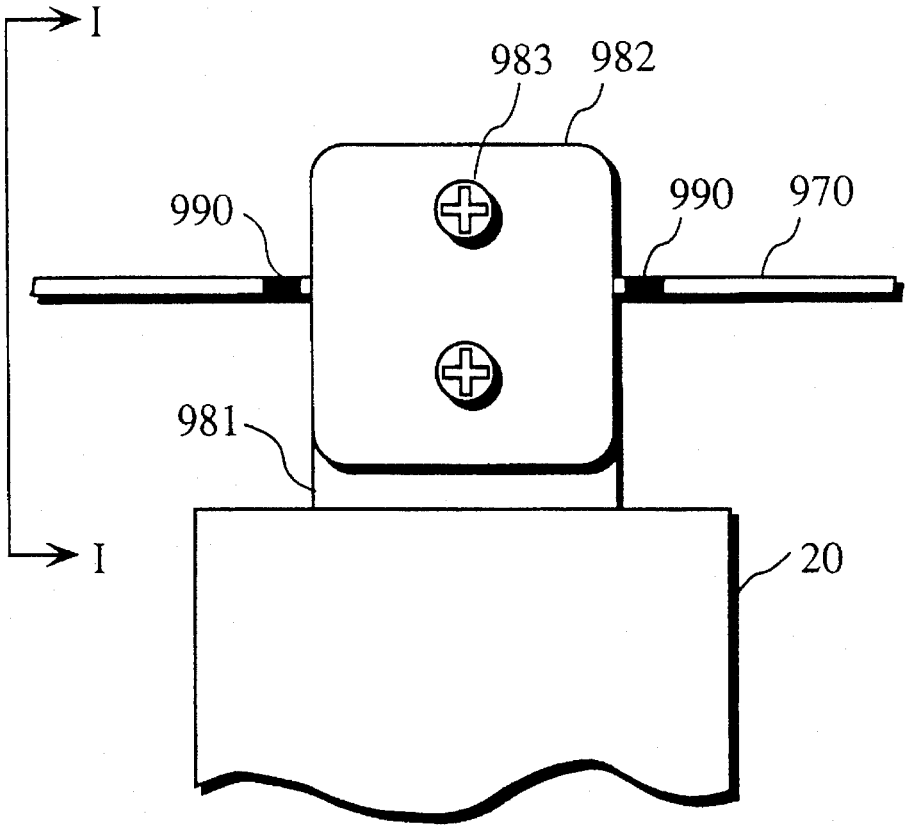
FIG. 37 is an enlarged plan view of a portion A shown in FIG. 34.
Figure 38:
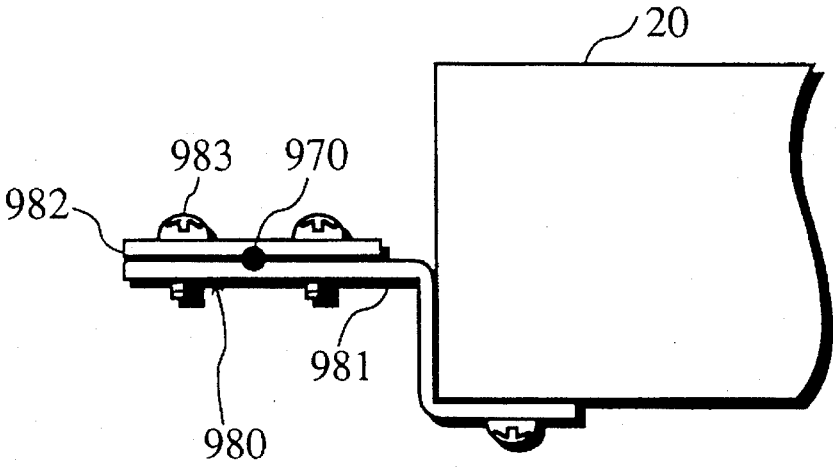
FIG. 38 is a perspective view taken along a line I—I shown in FIG. 37.

The first optical system traveling body 20 is mounted on the wire 970 by a wire fixture 980 mounted on its end. The wire fixture 980 comprises a bracket 981 mounted on an end of the first optical system traveling body 20 and a wire pressing plate 982, as shown in FIGS. 37 and 38. The bracket 981 and the wire pressing plate 982 are coupled to each other by screws 983 in a state where the wire 970 is interposed therebetween, whereby the wire 970 is clamped between the bracket 981 and the wire pressing plate 982.

Figure 39:
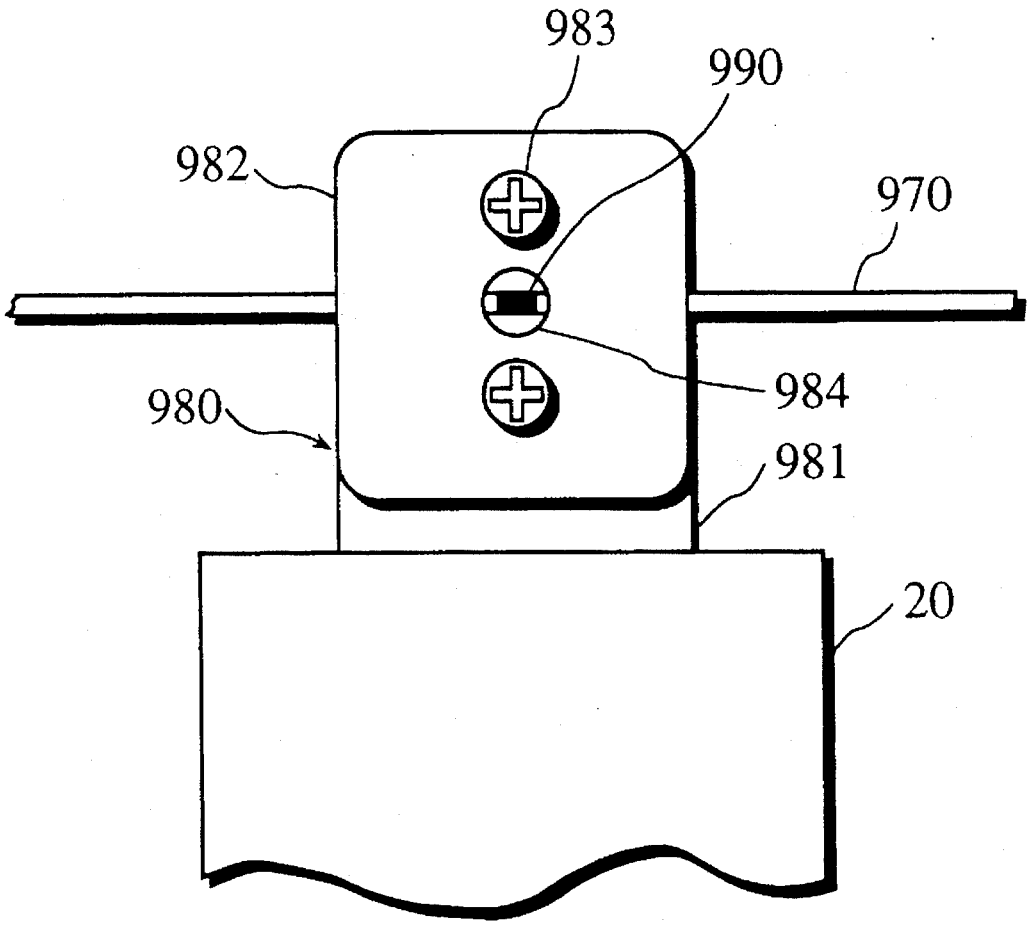
FIG. 39 is an enlarged plan view showing a modified example of a wire fixture.
Figure 40:
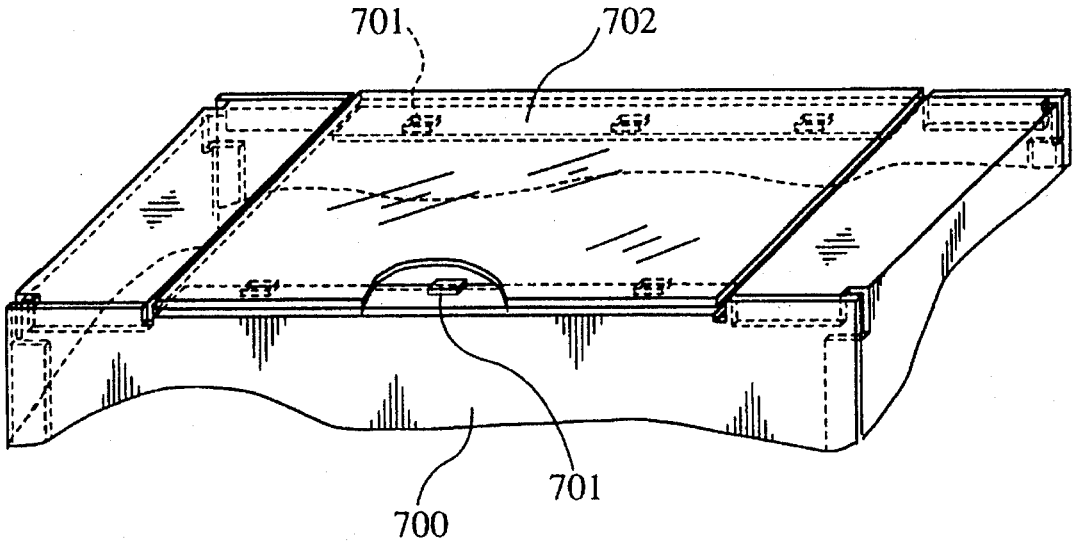
FIG. 40 (PRIOR ART)
FIG. 40 is a partially cutaway perspective view showing a mounting structure of a transparent platen on a frame in a conventional copying machine.

The position along the length of the wire 970 where the first optical system traveling body 20 is to be mounted is determined by adjusting the focus of an image at the time of manufacturing the copying machine, and the first optical system traveling body 20 is fixed to the determined position along the length of the wire 970 through the wire fixture 980. Marks 990 are given to the wire 970 so that the position along the length of the wire 970 is made clear. In this example, marks 990 are given to both positions outside the wire pressing plate 982 in the wire 970. As shown in FIG. 39, a hole 984 may be provided in the center of the wire pressing plate 982 to give a mark 990 to a position, which faces the hole 984, of the wire 970.

In the above described electrophotographic copying machine, the marks 990 indicating the mounting position of the first optical system traveling body 20 on the wire 970 which is determined by adjusting the focus of an image are given to the wire 970 at the time of manufacturing the copying machine. When the first optical system traveling body 20 is detached from the wire 970, and then the first optical system traveling body 20 is attached to the wire 970 again, therefore, the mounting position of the first optical system traveling body 20 on the wire 970 is found, whereby the focus of the image may not be adjusted.

Since the first optical system traveling body 20 can be thus easily mounted on the wire 970, it is easy to detach the first optical system traveling body 20 from the wire 970 when the first optical system is cleansed or the exposure lamps 21 and 22 are replaced, whereby cleaning work and replacing work become easy.

Although in the above described embodiment, description was made of the copying machine of a double wire type in which the wire driving mechanisms are provided on both sides with the first and second optical system traveling bodies 20 and 30 interposed therebetween, the present invention is also applicable to a copying machine of a single wire type in which a wire driving mechanism is provided on the side of only one of the first and second optical system traveling bodies 20 and 30.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, wherein a sealing member is interposed between a transparent platen on which an original is put and a frame member on which the transparent platen is mounted.

2. The image forming apparatus according to claim 1, wherein a plurality of height positioning sections in an upward projected shape are formed on the upper surface of the frame member, the sealing member is disposed on the upper surface of the frame member in such a manner as to pass outside or inside the height positioning sections, and the transparent platen is mounted on the frame member in a state where it is pressed against the sealing member and is received by the height positioning sections.

3. The image forming apparatus according to claim 1, wherein a plurality of height positioning sections in an upward projected shape are formed on the upper surface of the frame member, notches in which the height positioning sections are fitted are respectively formed in the sealing member in positions corresponding to the height positioning sections, the sealing member is disposed on the upper surface of the frame member in such a manner that the height positioning sections are respectively fitted in the notches in the sealing member and the transparent platen is mounted on the frame member in a state where it is pressed against the sealing member.

4. The image forming apparatus according to claim 1, wherein a plurality of height positioning sections in an upward projected shape are formed on the upper surface of the frame member, the sealing member is constituted by a plurality of sealing member parts respectively corresponding to portions between adjacent height positioning sections on the upper surface of the frame member, the sealing member parts are respectively fitted between the adjacent height positioning sections on the upper surface of the frame member, and the transparent platen is mounted on the frame member in a state where it is pressed against the sealing member and is received by the height positioning sections.

5. An image forming apparatus in which an original image is exposed by moving an exposure lamp, wherein a fluorescent lamp is used as the exposure lamp, an optical system for exposure including the exposure lamp is disposed in a sealed casing, the sealed casing is constituted by a case having a window for exposure and a transparent platen mounted on the case in such a manner as to close the window for exposure, and a sealing member is interposed between a portion around the window for exposure in the case and the transparent platen.

6. The image forming apparatus according to claim 5, wherein a plurality of height positioning sections in an upward projected shape are formed in the portion around the window for exposure in the case, the sealing member is disposed in such a manner as to pass outside or inside the height positioning sections in the portion around the window for exposure in the case, and the transparent platen is mounted on the case in a state where it is pressed against the sealing member and is received by the height positioning sections.

7. The image forming apparatus according to claim 5, wherein a plurality of height positioning sections in an upward projected shape are formed in the portion around the window for exposure in the case, notches in which the height positioning sections are fitted are respectively formed in the sealing member in positions corresponding to the height positioning sections, the sealing member is disposed in the portion around the window for exposure in the case in such a manner that the height positioning sections are respectively fitted in the notches in the sealing member, and the transparent platen is mounted on the case in a state where it is pressed against the sealing member.

8. The image forming apparatus according to claim 5, wherein a plurality of height positioning sections in an upward projected shape are formed in the portion around the window for exposure in the case, the sealing member is constituted by a plurality of sealing member parts respectively corresponding to portions between adjacent height positioning sections in the portion around the window for exposure in the case, the sealing member parts are respectively fitted between the adjacent height positioning sections in the portion around the window for exposure in the case, and the transparent platen is mounted on the case in a state where it is pressed against the sealing member and is received by the height positioning sections.

9. An image forming apparatus in which an original image is exposed by moving an exposure lamp, wherein a fluorescent lamp is used as the exposure lamp, an optical system for exposure including the exposure lamp is disposed in a sealed casing, the sealed casing is constituted by a case having a window for exposure and a transparent platen mounted on the case in such a manner as to close the window for exposure, the case is constituted by a case body opening upward and a cover fixed to the case body and having the window for exposure, and a sealing member is interposed between a portion around the window for exposure in the cover and the transparent platen.

10. The image forming apparatus according to claim 9, wherein a plurality of height positioning sections in an upward projected shape are formed in the portion around the window for exposure in the case, the sealing member is disposed in such a manner as to pass outside or inside the height positioning sections in the portion around the window for exposure in the case, and the transparent platen is mounted on the case in a state where it is pressed against the sealing member and is received by the height positioning sections.

11. The image forming apparatus according to claim 9, wherein a plurality of height positioning sections in an upward projected shape are formed in the portion around the window for exposure in the case, notches in which the height positioning sections are fitted are respectively formed in the sealing member in positions corresponding to the height positioning sections, the sealing member is disposed in the portion around the window for exposure in the case in such a manner that the height positioning sections are respectively fitted in the notches in the sealing member, and the transparent platen is mounted on the case in a state where it is pressed against the sealing member.

12. The image forming apparatus according to claim 9, wherein a plurality of height positioning sections in an upward projected shape are formed in the portion around the window for exposure in the case, the sealing member is constituted by a plurality of sealing member parts respectively corresponding to portions between adjacent height positioning sections in the portion around the window for exposure in the case, the sealing member parts are respectively fitted between the adjacent height positioning sections in the portion around the window for exposure in the case, and the transparent platen is mounted on the case in the a state where it is pressed against the sealing member and is received by the height positioning sections.

13. An image forming apparatus in which an original image is exposed by moving an exposure lamp, wherein a fluorescent lamp is used as the exposure lamp, an optical system for exposure including the exposure lamp is disposed in a sealed casing, the sealed casing is constituted by a case having a window for exposure and a transparent platen mounted on the case in such a manner as to close the window for exposure, the case is constituted by a case body having the window for exposure on its upper surface and opening downward and a bottom fixed to the case body, and a sealing member is interposed between a portion around the window for exposure in the case body and the transparent platen.

14. The image forming apparatus according to claim 13, wherein a plurality of height positioning sections in an upward projected shape are formed in the portion around the window for exposure in the case, the sealing member is disposed in such a manner as to pass outside or inside the height positioning sections in the portion around the window for exposure in the case, and the transparent platen is mounted on the case in a state where it is pressed against the sealing member and is received by the height positioning sections.

15. The image forming apparatus according to claim 13, wherein a plurality of height positioning sections in an upward projected shape are formed in the portion around the window for exposure in the case, notches in which the height positioning sections are fitted are respectively formed in the sealing member in positions corresponding to the height positioning sections, the sealing member is disposed in the portion around the window for exposure in the case in such a manner that the height positioning sections are respectively fitted in the notches in the sealing member, and the transparent platen is mounted on the case in a state where it is pressed against the sealing member.

16. The image forming apparatus according to claim 13, wherein a plurality of height positioning sections in an upward projected shape are formed in the portion around the window for exposure in the case, the sealing member is constituted by a plurality of sealing member parts respectively corresponding to portions between adjacent height positioning sections in the portion around the window for exposure in the case, the seal member parts are respectively fitted between the adjacent height positioning sections in the portion around the window for exposure in the case, and the transparent platen is mounted on the case in a state where it is pressed against the sealing member and is received by the height positioning sections.

* * * * *

UNITED STATES PATENT AND TRADEMARK OFFICE

CERTIFICATE OF CORRECTION

PATENT NO. : 5,521,681
DATED : May 28, 1996
INVENTOR(S) : Nimura, et al.

It is certified that error appears in the above-indentified patent and that said Letters Patent is hereby corrected as shown below:

Column 4

Line 58, change "A - A" to --1 - 1--;
Line 62, change "B - B" to --2 - 2--;
Line 66, cancel "graphs a"; and
Line 67, change "view showing" to --views showing a-; and change "C - C" to --3 - 3--.

Column 5

Line 2, change "D - D" to --4 - 4--;
Line 6, change "E - E" to --5 - 5--;
Line 7, change "F - F" to --6 - 6--;
Line 11, change "E - E" to --5 - 5--;
Line 12, change "F - F" to --6 - 6--;
Line 24, change "G - G" to --7 - 7--; and
Line 26, change "H - H" to --8 - 8--.

Column 11

Line 59, change "E - E" to --5 - 5--;
Line 60, change "F - F" to --6 - 6--; and
Line 67, change "E - E" to --5 - 5--.

UNITED STATES PATENT AND TRADEMARK OFFICE

CERTIFICATE OF CORRECTION

PATENT NO. : 5,521,681
DATED : May 28, 1996
INVENTOR(S) : Nimura, et al.

It is certified that error appears in the above-indentified patent and that said Letters Patent is hereby corrected as shown below:

Column 12

Line 1, change "F - F" to --6 - 6--.

Signed and Sealed this

Eleventh Day of March, 1997

Bruce Lehman

BRUCE LEHMAN

*Commissioner of Patents and Trademarks*

*Attest:*

*Attesting Officer*